US011335229B2

(12) United States Patent
Bae et al.

(10) Patent No.: US 11,335,229 B2
(45) Date of Patent: May 17, 2022

(54) DISPLAY FOR CONTROLLING OPERATION OF GAMMA BLOCK ON BASIS OF INDICATION OF CONTENT, AND ELECTRONIC DEVICE COMPRISING SAID DISPLAY

(71) Applicant: Samsung Electronics Co., Ltd., Suwon-si (KR)

(72) Inventors: Jongkon Bae, Suwon-si (KR); Yunpyo Hong, Suwon-si (KR); Donghwy Kim, Suwon-si (KR); Yohan Lee, Suwon-si (KR); Dongkyoon Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/770,784

(22) PCT Filed: Dec. 17, 2018

(86) PCT No.: PCT/KR2018/015995
§ 371 (c)(1),
(2) Date: Jun. 8, 2020

(87) PCT Pub. No.: WO2019/124900
PCT Pub. Date: Jun. 27, 2019

(65) Prior Publication Data

US 2020/0388206 A1 Dec. 10, 2020

(30) Foreign Application Priority Data

Dec. 20, 2017 (KR) ..... 10-2017-0176426

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2320/0673* (2013.01)

(58) Field of Classification Search
CPC ..... G09G 2300/0452; G09G 2310/027; G09G 2320/0673; G09G 3/20; G09G 3/2003
See application file for complete search history.

(56) References Cited

U.S. PATENT DOCUMENTS 6,950,045 B2 * 9/2005 Kim ..... G09G 3/3688 341/118
7,126,656 B2 * 10/2006 Lee ..... G02F 1/133512 349/110

(Continued)

FOREIGN PATENT DOCUMENTS

KR 10-0517734 B1 9/2005
KR 10-2006-0086170 A 7/2006

(Continued)

OTHER PUBLICATIONS

Korean Office Action dated Jan. 20, 2022, issued in Korean Patent Application No. 10-2017-0176426.

*Primary Examiner* — Chun-Nan Lin
(74) *Attorney, Agent, or Firm* — Jefferson IP Law, LLP

(57) ABSTRACT

According to various embodiments of the disclosure, a display may include a display panel including a first region in which first group subpixels are disposed and a second region in which second group subpixels are disposed, a converter group including converters respectively connected to subpixels included in the first group subpixels and the second group subpixels to transfer image data for output of specified content to the subpixels, a first group gamma circuit selectively connected to the converters to output a first grayscale voltage whose intensity is determined based on a plurality of binary bits, a second group gamma circuit (Continued)

selectively connected to the subpixels to output a second grayscale voltage whose intensity is determined based on a single binary bit, and a controller that controls selective connections between the first group gamma circuit and the converters and selective connections between the second group gamma circuit and the subpixels. According to an embodiment, the controller may receive the image data from an external processor and transfer the image data to the converter group, connect the first group gamma circuit with at least some converters such that the first group gamma circuit applies the first grayscale voltage to the at least some converters of the converter group, connect the second group gamma circuit with the second group subpixels such that the second group gamma circuit applies the second grayscale voltage to the second group subpixels, and output the specified content to at least a portion of the first region. In addition, various embodiments understood from the specification are possible.

10 Claims, 15 Drawing Sheets

(56) References Cited

U.S. PATENT DOCUMENTS

| | | | | |
|---|---|---|---|---|
| 8,339,301 | B2 | 12/2012 | Na et al. | |
| 8,508,557 | B2 * | 8/2013 | Park | G09G 3/3208 345/690 |
| 10,275,012 | B2 * | 4/2019 | Bae | G09G 3/2003 |
| 10,360,847 | B2 | 7/2019 | Lee et al. | |
| 2003/0197709 | A1 * | 10/2003 | Shimazaki | G09G 5/04 345/590 |
| 2003/0231193 | A1 * | 12/2003 | Shimazaki | H04N 9/641 345/690 |
| 2006/0092114 | A1 * | 5/2006 | Izumikawa | G09G 3/3648 345/89 |
| 2008/0032754 | A1 * | 2/2008 | Kim | H02J 7/0063 455/574 |
| 2011/0133972 | A1 * | 6/2011 | Na | G09G 3/2003 341/155 |
| 2015/0302789 | A1 * | 10/2015 | Furihata | G09G 3/3611 345/694 |
| 2016/0035293 | A1 * | 2/2016 | Furihata | G09G 5/02 345/694 |
| 2016/0314730 | A1 * | 10/2016 | Sampsell | G09G 3/2003 |
| 2016/0351104 | A1 * | 12/2016 | Yaras | G09G 3/2022 |
| 2016/0351135 | A1 * | 12/2016 | Sampsell | G09G 3/20 |
| 2017/0039961 | A1 * | 2/2017 | Sasagawa | G09G 3/2022 |
| 2017/0169763 | A1 * | 6/2017 | Bi | G09G 5/003 |
| 2017/0294156 | A1 * | 10/2017 | Pyo | G09G 3/3233 |
| 2017/0336851 | A1 * | 11/2017 | Bae | G06F 1/3265 |
| 2018/0130856 | A1 * | 5/2018 | Kim | H01L 27/3218 |
| 2018/0182343 | A1 * | 6/2018 | Fu | G09G 3/3607 |
| 2018/0366073 | A1 * | 12/2018 | Chen | G09G 3/36 |
| 2019/0172404 | A1 * | 6/2019 | Zhu | G09G 3/3607 |
| 2020/0082750 | A1 * | 3/2020 | Lv | G09G 3/20 |

FOREIGN PATENT DOCUMENTS

| | | | |
|---|---|---|---|
| KR | 10-2008-0089135 | A | 10/2008 |
| KR | 10-1000288 | B1 | 12/2010 |
| KR | 10-1117646 | B1 | 3/2012 |
| KR | 10-2016-0094542 | A | 8/2016 |
| KR | 10-2017-0006969 | A | 1/2017 |
| KR | 10-2017-0121676 | A | 11/2017 |
| KR | 10-2017-0131072 | A | 11/2017 |

* cited by examiner

DISPLAY FOR CONTROLLING OPERATION OF GAMMA BLOCK ON BASIS OF INDICATION OF CONTENT, AND ELECTRONIC DEVICE COMPRISING SAID DISPLAY

TECHNICAL FIELD

Embodiments disclosed in the disclosure relate to a display including a gamma block and an electronic device including the display.

BACKGROUND ART

With the development of information technology (IT), various types of electronic devices including a display, such as smart phones and tablet personal computers, have been widely used. A user may perform various functions such as Internet, games, and playback of video files through the display.

The display may provide content to the user through various colors of light, and the brightness, contrast, or grayscale of the various colors of light may be adjusted in various levels. In particular, the display may include a gamma block that applies grayscale voltages with various magnitudes to pixels included in the display to adjust the grayscale.

Meanwhile, in recent years, the electronic device may have a so-called always on display (AOD) function that allows specified content to be always displayed even when the user does not use the electronic device.

DISCLOSURE

Technical Problem

The AOD function requires continuous output of image data, leading to inevitable power consumption of a predetermined magnitude or more. The power consumption is directly related to the battery life of the electronic device, and power consumption of a predetermined magnitude or more may shorten the use time of the electronic device.

A method of minimizing the levels of a grayscale voltage applied to pixels may be considered to minimize the power consumption, but in this case, an image quality of content output to the display may be deteriorated.

Accordingly, there is a need for a method capable of maintaining the image quality of the content above a specified level while minimizing power consumption.

Technical Solution

According to an embodiment disclosed in the disclosure, a display may include a display panel including a first region in which first group subpixels are disposed and a second region in which second group subpixels are disposed, a converter group including converters respectively connected to subpixels included in the first group subpixels and the second group subpixels to transfer image data for output of specified content to the subpixels, a first group gamma circuit selectively connected to the converters to output a first grayscale voltage whose intensity is determined based on a plurality of binary bits, a second group gamma circuit selectively connected to the subpixels to output a second grayscale voltage whose intensity is determined based on a single binary bit, and a controller that controls selective connections between the first group gamma circuit and the converters and selective connections between the second group gamma circuit and the subpixels, and the controller may receive the image data from an external processor and transfer the image data to the converter group, connect the first group gamma circuit with at least some converters such that the first group gamma circuit applies the first grayscale voltage to the at least some converters of the converter group, connect the second group gamma circuit with the second group subpixels such that the second group gamma circuit applies the second grayscale voltage to the second group subpixels, and output the specified content to at least a portion of the first region.

Further, according to an embodiment disclosed in the disclosure, an electronic device may include a display panel including a display area and a non-display area, and a display driving circuit that drives the display panel and includes a gamma driving circuit including a first group gamma circuit and a second group gamma circuit, and the display driving circuit may identify the display area on which content is to be displayed, display the content on the display area using the gamma driving circuit set to a state in which an output of the first group gamma circuit is activated and an output of the second group gamma circuit is deactivated, and display a specified color on the non-display area on which the content is not displayed, using the gamma driving circuit set to a state in which the output of the first group gamma circuit is deactivated and the output of the second group gamma circuit is activated.

Advantageous Effects

According to the embodiments disclosed in the disclosure, it is possible to provide a variety of high-definition content to the user even in the AOD state, thus providing higher use convenience to the user. In addition, it is possible to efficiently control the power consumption of the electronic device, thereby providing a longer usage time to the user. In addition, various effects may be provided that are directly or indirectly understood through the disclosure.

DESCRIPTION OF DRAWINGS

In the description of the drawings, the same or similar reference numerals may be used for the same or similar components.

MODE FOR INVENTION

Figure 1:
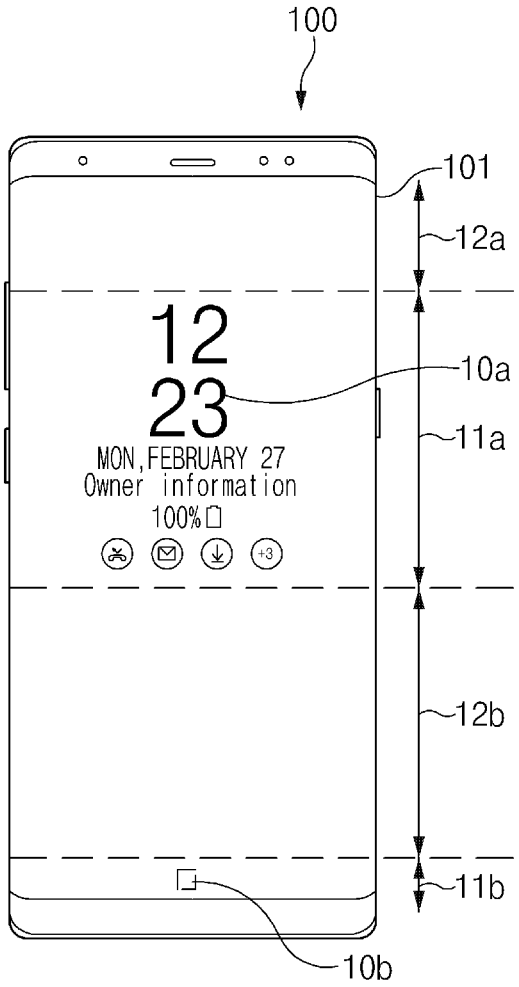
FIG. 1 illustrates a front view of an electronic device being in an AOD state, according to an embodiment.

FIG. 1 is a front view of an electronic device being in an AOD state, according to an embodiment.

Referring to FIG. 1, an electronic device 100 may include a display 101 in which at least a part of a screen is exposed in a front direction. In one embodiment, the display 101 may output specified content (e.g., text, images, videos, icons, widgets, or symbols, or the like) or receive an input (e.g., touch input or electronic pen input) from a user.

According to an embodiment, the electronic device 100 may support an AOD function. Accordingly, an operation mode of the electronic device 100 (e.g., an operation mode of the display 101) may include a normal mode and an AOD mode. In one embodiment, the normal mode may be an operation mode in which the AOD function is not executed and the electronic device 100 is able to provide various types of functions (e.g., Internet, game, image or video shooting, execution of various applications, or playback of video files) to a user.

According to an embodiment, the AOD mode may be an operation mode in which the electronic device 100 is able to provide a user with relatively limited functions compared to the normal mode. In the AOD mode, the electronic device 100 may display specified content (e.g., clock, date, image, battery status, or home button) in a specified area even when the user does not use the electronic device 100.

In one embodiment, when the electronic device 100 is in the AOD mode, a processor included in the electronic device 100 may switch an operation state to a low power state (e.g., an inactive state or a sleep state). In this case, an operation of outputting the content to the display 101 of the electronic device 100 may be performed, for example, by a display driving circuit.

According to an embodiment, the display driving circuit may be a circuit that controls the operation of the display 101. For example, the display driving circuit may provide image data to pixels included in the display 101. For another example, the display driving circuit may change at least one of brightness, contrast, or grayscale of a screen output to the display 101.

According to an embodiment, in the AOD mode, the display driving circuit may be operated by an internal power module. In the AOD mode, the display driving circuit may provide image data to the pixels at a lower driving frequency than that in the normal mode.

According to an embodiment, the area of the display 101 may be divided according to whether content is displayed. For example, as shown in FIG. 1, the area of the display 101 may include a first region 11*a* displaying first content 10*a* and a first region 11*b* displaying second content 10*b*, and may include second regions 12*a* and 12*b* that do not include the first content 10*a* and the second content 10*b*.

In one embodiment, the first content 10*a* may include time, day of the week, date, and/or information (message reception, missed call) capable of being provided to the user. In one embodiment, the second content 10*b* may be content displaying a specified object (e.g., a home button). The user may switch the operation mode of the electronic device 100 from the AOD mode to the normal mode by applying a touch input (e.g., pressure, double tap, long press, or the like) to the second content 10*b*.

In various embodiments, division of the area of the display 101 may be applied to division of an area of the display panel in the same or similar manner. For example, the display panel may include the first region 11*a* including pixels that display the first content 10*a*, the first region 11*b* including pixels that display the second content 10*b*, and the second regions 12*a* and 12*b* including pixels that do not display the first content 10*a* and the second content 10*b*. In the disclosure, the first regions 11*a* and 11*b* may be referred to as display areas, and the second regions 12*a* and 12*b* may be referred to as non-display areas.

According to an embodiment, a grayscale voltage may be applied to pixels included in the display panel by a gamma block. The gamma block may apply the grayscale voltage to pixels included in the display panel and adjust a grayscale value of light emitted by the pixels.

According to an embodiment, the grayscale voltage may include a plurality of grayscale voltages classified according to an intensity of the grayscale voltage. For example, the grayscale voltages may have 256 different grayscale voltages classified by a plurality of binary bits, for example, 8 binary bits. In various embodiments, the number of the plurality of binary bits may be 10, 12, or more. When the grayscale voltages of different intensities are applied to the pixels, the light emitted by the pixels may have different grayscale values. For another example, the grayscale voltages may have two different grayscale voltages distinguished by a single binary bit. The pixels may represent light having different grayscale values by one of the two grayscale voltages.

According to various embodiments, the level of the grayscale voltage by the single binary bit may be variously set. For example, the grayscale voltage by the single binary bit may be set to have any two different grayscale voltages among 256 different grayscale voltages by the 8-bit binary bits.

According to an embodiment, different grayscale voltages may be applied to pixels disposed in the first regions 11*a* and 11*b* and pixels disposed in the second regions 12*a* and 12*b*. For example, a first grayscale voltage may be applied to pixels disposed in the first regions 11*a* and 11*b* including content (e.g., the first content 10*a* or the second content 10*b*), and a second grayscale voltage may be applied to pixels disposed in the second regions 12*a* and 12*b* that do not include the content.

According to an embodiment, the gamma block may include a first group gamma circuit that generate the first grayscale voltage and a second group gamma circuit that generate the second grayscale voltage.

According to an embodiment, the first group gamma circuit may be set such that the intensity of the grayscale voltage is adjusted by a plurality of binary bits, for example, 8 binary bits, to maintain an image quality of the content above a specified level. According to an embodiment, the second group gamma circuit may be set such that the intensity of the grayscale voltage is adjusted by a single binary bit to minimize power consumption.

According to various embodiments, the division of the area of the display 101 or the display panel shown in FIG. 1 may be exemplary and embodiments of the disclosure are not limited to those shown in FIG. 1. For example, the division of the area of the display 101 or the display panel may be divided transversely as shown in FIG. 1 or divided longitudinally unlike what is shown in FIG. 1.

In the disclosure, the contents described with reference to FIG. 1 may be identically applied with respect to components having the same reference numerals as the electronic device 100 shown in FIG. 1.

Figure 2:
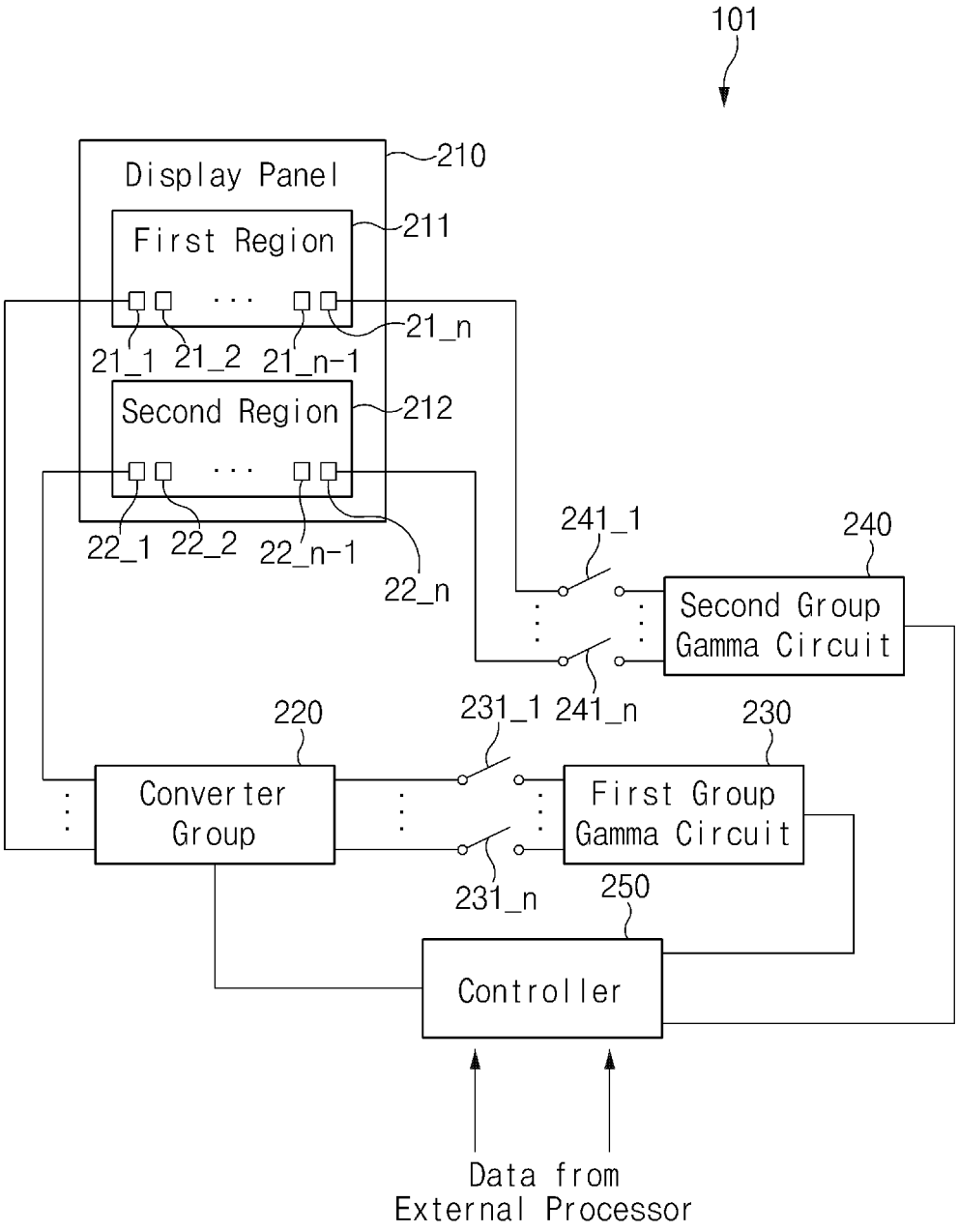
FIG. 2 illustrates a block diagram of a display, according to an embodiment.

FIG. 2 illustrates a block diagram of a display, according to an embodiment.

Referring to FIG. 2, the display 101 may include a display panel 210, a converter group 220, a first group gamma circuit 230, a second group gamma circuit 240, a first group switches 231_1 to **231_*n*, a second group switches 241_1 to 241_*n*, and a controller 250. According to various embodiments, in the display 101, some of the components shown in FIG. 2 may be omitted, other components not shown in FIG. 2 may be additionally included, or some components may be included in the remaining components. For example, the first group switches 231_1 to 231_*n* may be included in the first group gamma circuit 230 and the second group switches 241_1 to 241_*n* may be included in the second group gamma circuit 240**.

According to an embodiment, the remaining components except the display panel 210 in the display 101, for example, the converter group 220, the first group gamma circuit 230, the second group gamma circuit 240, the first group switches 231_1 to **231_*n*, the second group switches 241_1 to 241_*n*, and the controller 250 may constitute a display driving circuit DDI for operation of the display 101**.

The display panel 210 may include a first region 211 and a second region 212. According to an embodiment, the first region 211 and the second region 212 may represent regions of the display panel 210 corresponding to the first regions **11*a* and 11*b* and the second regions 12*a* and 12*b* shown in FIG. 1. In one embodiment, pixels arranged in the first region 211 of the display panel 210 emit light to display a screen including content in the first regions 11*a* and 11*b* of the display 101 as shown in FIG. 1. Pixels disposed in the second region 212 of the display panel 210 may emit light to display a screen that does not include content in the second regions 12*a* and 12*b* of the display 101**.

According to an embodiment, the pixels included in the first region 211 and the second region 212 may include a plurality of subpixels 21_1 to **21_*n* and 22_1 to 22_*n*, respectively. Each of the subpixels 21_1 to 21_*n* and 22_1 to 22_*n*** may be, for example, one of a red subpixel, a green subpixel, and a blue subpixel.

In one embodiment, one pixel may have an RGB stripe layout structure including one red subpixel, one green subpixel, and one blue subpixel. In another embodiment, one pixel may have a pentile layout structure including a red subpixel and a green subpixel, or a green subpixel and a blue subpixel.

According to an embodiment, the subpixels 21_1 to **21_*n* disposed in the first region 211 may be referred to as the first group subpixels 21_1 to 21_*n*, and the subpixels 22_1 to 22_*n* disposed in the second region 212 may be referred to as the second group subpixels 22_1 to 22_*n***.

According to an embodiment, each of the subpixels 21_1 to **21_*n* and 22_1 to 22_*n* included in the first group subpixels 21_1 to 21_*n* and the second group subpixels 22_1 to 22_*n* may be electrically connected to converters included in the converter group 220. According to an embodiment, each of the subpixels 21_1 to 21_*n* and 22_1 to 22_*n* may be selectively connected to the second group gamma circuit 240. According to an embodiment, the selective connection between the subpixels 21_1 to 21_*n* and 22_1 to 22_*n* and the second group gamma circuit 240 may be implemented by turning on or off the second group switches 241_1 to 241_*n***.

The converter group 220 may include a plurality of converters. The converters may be electrically connected to the subpixels 21_1 to **21_*n* and 22_1 to 22_*n*, respectively and transfer image data received from the controller 250 to the subpixels 21_1 to 21_*n* and 22_1 to 22_*n*. The subpixels 21_1 to 21_*n* and 22_1 to 22_*n* may display a screen corresponding to the image data on the display 101** by emitting light corresponding to the image data.

According to an embodiment, the converter group 220 may convert the image data received from the controller 250 from a digital signal to an analog signal. The analog signal may be, for example, a source voltage value transferred to the subpixels 21_1 to **21_*n* and 22_1 to 22_*n***.

According to an embodiment, the converter group 220 may be electrically connected to the first group gamma circuit 230. For example, each of the converters included in the converter group 220 may be selectively connected to the first group gamma circuit 230. According to an embodiment, the selective connection between the converters and the first group gamma circuit 230 may be implemented by turning on or off the first group switches 231_1 to **231_*n***.

The first group gamma circuit 230 may be selectively connected to the converter group 220 and apply a first grayscale voltage to the converter group 220. The first grayscale voltage may be combined with image data converted into an analog signal by the converter group 220, and be transferred to the subpixels 21_1 to **21_*n* and 22_1 to 22_*n* disposed on the display panel 210. In other words, it can be understood that the first grayscale voltage is transferred to the subpixels 21_1 to 21_*n* and 22_1 to 22_*n*** through a converter.

According to an embodiment, the first group gamma circuit 230 may apply the first grayscale voltage whose intensity is determined by a plurality of binary bits to the converter group 220. The plurality of binary bits may be, for example, eight binary bits, and in this case, the first grayscale voltage may have 256 different intensities. According to another embodiment, the plurality of binary bits may be, for example, four binary bits, and in this case, the first grayscale voltage may have 128 different intensities. According to still another embodiment, the plurality of binary bits may be, for example, 10, 12 or more binary bits. In this case, the intensity of the first grayscale voltage may have various values as many as the power of 2 corresponding to the number of binary bits. For example, in the case of 10 binary bits, the first grayscale voltage may have 1024 different intensities.

According to an embodiment, the first group gamma circuit 230 may be configured to apply the first grayscale voltage to at least some of a plurality of converters included in the converter group 220. For example, the first group gamma circuit 230 may be configured to apply the first grayscale voltage to at least some of converters electrically connected to the first group subpixels 21_1 to **21_*n*. For another example, the first group gamma circuit 230 may be configured to apply the first grayscale voltage to all of the converters electrically connected to the first group subpixels 21_1 to 21_*n***.

According to an embodiment, the first group gamma circuit 230 may include a plurality of gamma amplifiers. The gamma amplifier may generate first grayscale voltages having various magnitudes.

The second group gamma circuit 240 may be selectively connected to the subpixels 21_1 to **21_*n* and 22_1 to 22_*n*** included in the first group subpixels 21_1 to **21_*n* and the second group subpixels 22_1 to 22_*n* and apply a second grayscale voltage to the subpixels 21_1 to 21_*n* and 22_1 to 22_*n*. In one embodiment, the second grayscale voltage may be understood to be combined with image data converted to an analog signal by the converter group 220**.

According to an embodiment, the second group gamma circuit 240 may apply the second grayscale voltage whose intensity is determined by a single binary bit to the converter group 220. In this case, the second grayscale voltage may have two different intensities. For example, the second group gamma circuit 240 may include an inverter. The inverter may generate second grayscale voltages having two different intensities.

According to an embodiment, the second group gamma circuit 240 may be configured to apply the second grayscale voltage to the second group subpixels 22_1 to **22_*n*. In one embodiment, the second group gamma circuit 240 may be configured to apply the second grayscale voltage to the second group subpixels 22_1 to 22_*n* and at least some of the first group subpixels 21_1 to 21_*n*. For example, it may be configured to apply the first grayscale voltage to at least some of the first group subpixels 21_1 to 21_*n* by the first group gamma circuit 230. The second group gamma circuit 240 may be configured to apply the second grayscale voltage to the remaining subpixels except at least some of the first group subpixels 21_1 to 21_*n***.

According to an embodiment, the first group gamma circuit 230 may be configured to apply the first grayscale voltage to the second group subpixels 22_1 to **22_*n* in place of the second group gamma circuit 240**.

According to an embodiment, it may be configured to apply the second grayscale voltage to the first group subpixels 21_1 to **21_*n* to which the first grayscale voltage is applied, after a specified time has elapsed. For example, the first group gamma circuit 230 may be connected to at least some converters during the specified time. The first grayscale voltage may be applied to some of the first group subpixels 21_1 to 21_*n* connected to the at least some converters during the specified time. When the specified time has elapsed, the second group gamma circuit 240 and some of the first group subpixels 21_1 to 21_*n* may be connected such that the second grayscale voltage is applied to the first group subpixels 21_1 to 21_*n*** connected to the at least some converters, instead of the first grayscale voltage.

According to an embodiment, the specified time may be variously set. For example, the specified time may be set to a fixed time by a timer function of the controller 250. For another example, the specified time may be set to a variable time through a sensor that detects the user's condition. For example, the specified time may be set to a time when the user looks at the electronic device 100 through a sensor that detects the user's gaze or a sensor that detects a posture of the electronic device 100. For another example, the specified time may be set to a variable time according to content output to a first region, ambient brightness of the electronic device 100, or the like.

According to an embodiment, when a change in content output to the display 101 occurs, the first grayscale voltage may be applied again to some of the first group subpixels 21_1 to **21_*n* to which the second grayscale voltage is applied. For example, new image data different from existing image data may be received from an external processor. In this case, in response to the reception of the new image data, some converters connected to some of the first group subpixels 21_1 to 21_*n* to which the second grayscale voltage is applied may be connected to the first group gamma circuit 230. In this case, the first grayscale voltage may be applied to some of the first group subpixels 21_1 to 21_*n***, instead of the second grayscale voltage.

The controller 250 may be electrically connected to the converter group 220, the first group gamma circuit 230, and the second group gamma circuit 240. According to an embodiment, the controller 250 may be configured to control connections between the first group gamma circuit 230 and converters in the converter group 220 and connections between the second group gamma circuit 240 and the subpixels 21_1 to **21_*n* and 22_1 to 22_*n*. For example, the controller 250 may control connections between the first group gamma circuit 230 and the converters and connections between the second group gamma circuit 240 and the subpixels 21_1 to 21_*n* and 22_1 to 22_*n* by controlling the first group switches 231_1 to 231_*n* and the second group switches 241_1 to 241_*n***.

According to an embodiment, the controller 250 may control the first group switches 231_1 to **231_*n* and the second group switches 241_1 to 241_*n* to selectively apply one of the first grayscale voltage and the second grayscale voltage to one of the subpixels. For example, the subpixels 21_1 to 21_*n* and 22_1 to 22_*n* may include an arbitrary first subpixel. The controller 250 may perform control such that the connection between the converter connected to the first subpixel and the first group gamma circuit 230 and the connection between the first subpixel and the second group gamma circuit 240** are selectively made.

According to an embodiment, the controller 250 may be configured to apply the first grayscale voltage to the first group subpixels 21_1 to **21_*n* during a first time, and apply the second grayscale voltage to the second group subpixels 22_1 to 22_*n* during a second time different from the first time. For example, the controller 250 may connect the first group gamma circuit 230 with at least some converters such that the first group gamma circuit 230 applies the first grayscale voltage to the at least some converters of the converter group 220 during the first time. The controller 250 may connect the second group gamma circuit 240 with the second group subpixels 22_1 to 22_*n* such that the second group gamma circuit 240 applies the second grayscale voltage to the second group subpixels 22_1 to 22_*n*** during the second time.

According to an embodiment, the controller 250 may control the first group switches 231_1 to **231_*n* and the second group switches 241_1 to 241_*n* during the first time and the second time. For example, the controller 250 may turn on the first group switches 231_1 to 231_*n* and turn off the second group switches 241_1 to 241_*n* during the first time. For another example, the controller 250 may turn off the first group switches 231_1 to 231_*n* and turn on the second group switches 241_1 to 241_*n*** during the second time.

According to an embodiment, the controller 250 may connect the first group gamma circuit 230 with at least some converters such that the first group gamma circuit 230 applies the first grayscale voltage to the at least some converters of the converter group 220. For example, the controller 250 may connect the first group gamma circuit 230 with all or some of a plurality of converters included in the converter group 220.

Through this, the first grayscale voltage may be applied to at least some of the first group subpixels 21_1 to **21_*n*, and specified content displayed by the first group subpixels 21_1 to 21_*n*** may secure an image quality of a specified level or higher.

According to an embodiment, the controller 250 may connect the second group gamma circuit 240 to the second group subpixels 22_1 to **22_*n* such that the second group gamma circuit 240 applies the second grayscale voltage with the second group subpixels 22_1 to 22_*n***.

Through this, the second grayscale voltage may be applied to the second group subpixels 22_1 to **22_*n*, and power consumption may be reduced below a specified level in the second group subpixels 22_1 to 22_*n***.

According to an embodiment, the controller 250 may connect the second group gamma circuit 240 to at least some of the first group subpixels 21_1 to **21_*n* such that the second group gamma circuit 240 applies the second grayscale voltage with at least some of the first group subpixels 21_1 to 21_*n*. For example, it may be configured to apply the first grayscale voltage to at least some of the first group subpixels 21_1 to 21_*n* and the controller 250 may connect the second group gamma circuit 240 with the remaining subpixels to apply the second grayscale voltage to the remaining subpixels except the at least some of the first group subpixels 21_1 to 21_*n***.

Accordingly, the second grayscale voltage may be applied to some of the first group subpixels 21_1 to **21_*n*, and power consumption may be reduced below a specified level in some of the first group subpixels 21_1 to 21_*n***.

According to an embodiment, the controller 250 may receive image data from an external processor of the display 101. The external processor may be, for example, an application processor that may be included in the electronic device 100. In one embodiment, the application processor may transmit the image data to the controller 250 in the display 101 for the AOD mode and switch an operation mode to an inactive mode or sleep mode. In one embodiment, the controller 250 may transmit the received image data to the converter group 220.

In the disclosure, the contents described with reference to FIG. 2 may be identically applied with respect to components having the same reference numerals as the display 101 shown in FIG. 2.

Figure 3A:
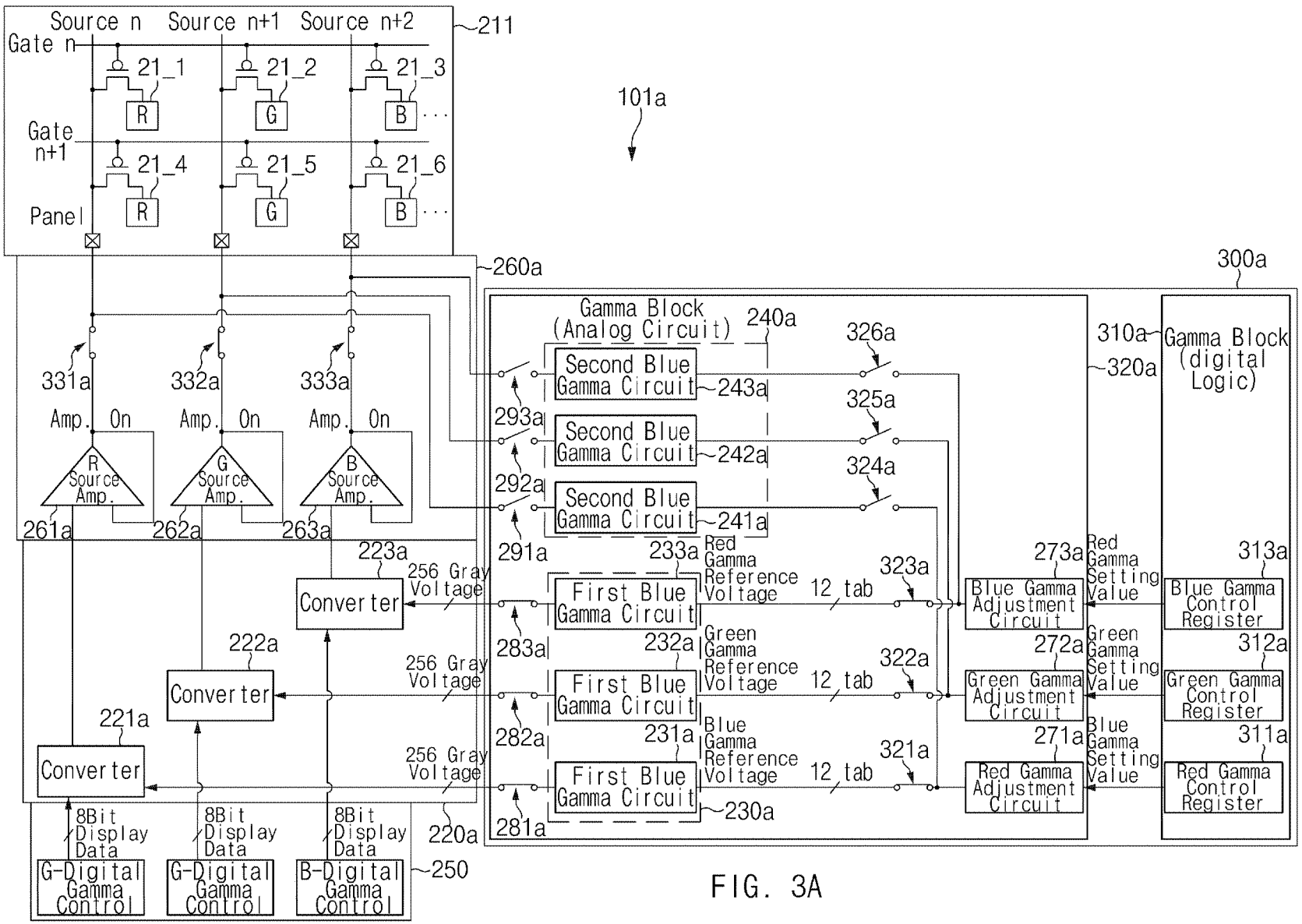
FIG. 3A illustrates a detailed block diagram of a first region of a display, according to an embodiment.

FIG. 3A illustrates a detailed block diagram of a first region of a display, according to an embodiment.

Referring to FIG. 3A, a display **101*a* may include a display panel 211 in a first region, a source amplifier group 260*a*, a converter group 220*a*, the controller 250, and a gamma block 300*a*. According to various embodiments, some of the components shown in FIG. 3A may be omitted, or components not shown in FIG. 3A may be added. For example, the display 101*a* may further include a gate driver that applies a gate voltage to the display panel 211. According to various embodiments, the display 101*a* shown in FIG. 3A is merely for one channel, and it may be understood that the display 101*a*** including a plurality of channels include a plurality of sets each including the above-listed components.

According to various embodiments, the display **101*a* is shown in FIG. 3A as including the display panel 211 of an RGB stripe layout structure type, but is not limited thereto. For example, the display 101*a* may include the display panel 211** of a pentile layout structure type.

The display panel 211 for the first region may include a plurality of gate lines and a plurality of source lines. In one embodiment, the plurality of gate lines and the plurality of source lines may intersect each other. The subpixels 21_1, 21_2, 21_3, 21_4, 21_5, and 21_6 may be disposed at intersection points of the gate lines and the source lines. The subpixels 21_1, 21_2, 21_3, 21_4, 21_5, and 21_6 may constitute first group subpixels 21_1, 21_2, 21_3, 21_4, 21_5, and 21_6. According to an embodiment, in the RGB stripe layout structure type, three subpixels (e.g., the subpixels 21_1, 21_2, and 21_3 of RGB) may constitute one pixel.

According to an embodiment, a gate voltage may be sequentially applied to the plurality of gate lines by a gate driver. For example, the gate driver may apply the gate voltage to an (n+1)-th gate line after applying the gate voltage to an n-th gate line. For another example, the gate driver may apply the gate voltage to the n-th gate line after applying the gate voltage to the (n+1)-th gate line.

In one embodiment, when the gate voltage is applied to the gate line, the same gate voltage may be applied to a plurality of subpixels (e.g., subpixels 21_1, 21_2, and 21_3 included in the n-th gate line) connected to the gate line, at the same time point.

According to an embodiment, the plurality of subpixels to which the gate voltage is applied (e.g., subpixels 21_1, 21_2, and 21_3 included in the n-th gate line) may emit light with a specified brightness based on the magnitude of the source voltage applied to the subpixels. In other words, the subpixels may emit light with the specified brightness based on the magnitude of the source voltage applied at the time point at which the gate voltage is applied. According to an embodiment, the source voltage may be image data converted from a digital signal to an analog signal.

According to an embodiment, the source voltage may be sequentially applied to the plurality of source lines by a source driver. For example, the source driver may sequentially apply the source voltage to subpixels 21_1, 21_2, and 21_3 constituting the n-th gate line during a time when the gate voltage is applied to the n-th gate line. The subpixels may emit light based on the applied source voltage. The source driver may include, for example, the source amplifier group **260*a*, the converter group 220*a*, and the gamma block 300*a***.

According to an embodiment, in each of the source lines, red subpixels 21_1 and 21_4 may be disposed, green subpixels 21_2 and 21_5 may be disposed, or blue subpixels 21_3 and 21_6 may be disposed. The source line on which the red subpixels 21_1 and 21_4 are disposed may be connected to a red source amplifier **261*a*, the source line on which the green subpixels 21_2 and 21_5 are disposed may be connected to a green source amplifier 262*a*, and the source line on which the blue subpixels 21_3 and 21_6 are disposed may be connected to a blue source amplifier 263*a***.

The source amplifier group **260*a* may include a plurality of source amplifiers 261*a*, 262*a*, and 263*a*. For example, the source amplifier group 260*a* may include the red source amplifier 261*a*, the green source amplifier 262*a*, and the blue source amplifier 263*a*. According to an embodiment, switches 331*a*, 332*a*, and 333*a* may be disposed at output terminals of the plurality of source amplifiers 261*a*, 262*a*, and 263*a*. The plurality of source amplifiers 261*a*, 262*a*, and 263*a* may sequentially apply a source voltage to the subpixels 21_1, 21_2, 21_3, 21_4, 21_5, and 21_6 by the switches 331*a*, 332*a*, and 333*a***.

The converter group **220*a* may include a plurality of converters 221*a*, 222*a*, and 223*a*. According to an embodiment, the plurality of converters 221*a*, 222*a*, and 223*a* may be electrically connected to the subpixels 21_1, 21_2, 21_3, 21_4, 21_5, and 21_6 through the plurality of source amplifiers 261*a*, 262*a*, and 263*a*. According to an embodiment, the converter group 220*a* may convert image data transmitted from the controller 250** from a digital signal to an analog signal.

According to an embodiment, the plurality of converters **221*a*, 222*a*, and 223*a* included in the converter group 220*a*** may be selectively connected to a first group gamma circuit 230*a* included in the gamma block 300*a*. In one embodiment, a first grayscale voltage may be applied from at least a part of the first group gamma circuit 230*a* to at least some of the plurality of converters 221*a*, 222*a*, and 223*a*. The applied first grayscale voltage may be combined with the image data which is converted.

The controller 250 may receive image data from an external processor and transmit the image data to the converter group 220*a*. The image data may include data for outputting specified content to the display panel 211 for the first region.

According to an embodiment, the controller 250 may control operations of the gate driver and the source driver. For example, the controller 250 may control turning-on or -off of switches (e.g., 331*a*, 281*a*, 291*a*, 321*a*, and 324*a*) included in the source amplifier group 260*a* and the gamma block 300*a*.

The gamma block 300*a* may generate an analog gamma value (e.g., grayscale voltage) related to the color of each of the subpixels 21_1, 21_2, 21_3, 21_4, 21_5, and 21_6. In one embodiment, the gamma block 300*a* may include a digital gamma block 310*a* and an analog gamma block 320*a*.

The digital gamma block 310*a* may include a red gamma register 311*a*, a green gamma register 312*a*, and a blue gamma register 313*a*. Each of the gamma control registers 311*a*, 312*a*, and 313*a* may transmit a gamma setting value corresponding to corresponding subpixels to the analog gamma block.

The analog gamma block 320*a* may include gamma adjustment circuits 271*a*, 272*a*, and 271*a*, the first group gamma circuit 230*a*, and a second group gamma circuit 240*a*. The analog gamma block 320*a* may generate a grayscale voltage (e.g., a first grayscale voltage or a second grayscale voltage) based on the gamma setting value received from the digital gamma block 310*a*. The generated grayscale voltage may be transmitted to the converter group 220*a* or the output terminal of the source amplifier group 260*a*.

According to one embodiment, the gamma adjustment circuits 271*a*, 272*a*, and 273*a* may include the red gamma adjustment circuit 271*a*, the green gamma adjustment circuit 272*a*, and the blue gamma adjustment circuit 273*a* based on the colors of the subpixels 21_1, 21_2, 21_3, 21_4, 21_5, and 21_6. Each of the gamma adjustment circuits 271*a*, 272*a*, and 273*a* may generate a gamma reference voltage based on the gamma setting values received from the gamma control registers 311*a*, 312*a*, and 313*a*. In one embodiment, the gamma reference voltage may have various values according to the gamma setting value. In various embodiments, the generated gamma reference voltage may be transmitted to the first group gamma circuit 230*a* or the second group gamma circuit 240*a*.

According to one embodiment, the gamma adjustment circuits 271*a*, 272*a*, and 273*a* may be electrically connected to the first group gamma circuit 230*a* through the first reference switches 321*a*, 322*a*, and 323*a*, and be electrically connected to the second group gamma circuit 240*a* through the second reference switches 324*a*, 325*a*, and 326*a*.

According to an embodiment, as shown in FIG. 3A, when image data is transmitted to the first group subpixels 21_1, 21_2, 21_3, 21_4, 21_5, and 21_6, the first reference switches 321*a*, 322*a*, and 323*a* may be turned on, and the second reference switches 324*a*, 325*a*, and 326*a* may be turned off. In this case, the gamma reference voltage may be transmitted to the first group gamma circuit 230*a* and may not be transmitted to the second group gamma circuit 240*a*.

According to another embodiment, unlike FIG. 3A, when image data is transmitted to the first group subpixels 21_1, 21_2, 21_3, 21_4, 21_5, and 21_6, the first reference switches 321*a*, 322*a*, and 323*a* and the second reference switches 324*a*, 325*a*, and 326*a* may all be turned on. In this case, the gamma reference voltage may be transmitted to both the first group gamma circuit 230*a* and the second group gamma circuit 240*a*.

According to an embodiment, the first group gamma circuit 230*a* may generate a plurality of first grayscale voltages based on the received gamma reference voltage. The intensity of the first grayscale voltage may have different values based on a plurality of binary bits. For example, the first grayscale voltage may include 256 different grayscale voltages based on eight binary bits. The intensity of the first grayscale voltage may be controlled by the controller 250.

According to various embodiments, the number of the plurality of binary bits may vary. For example, the number of the plurality of binary bits may be four, and in this case, the first grayscale voltage may include grayscale voltages having 16 different intensities.

According to an embodiment, the first switches 281*a*, 282*a*, and 283*a* may be included at the output terminal of the first group gamma circuit 230*a*. The first switches 281*a*, 282*a*, and 283*a* may be, for example, the first group switches 231_1 to 231_*n* shown in FIG. 2.

According to an embodiment, when image data is transmitted to the first group subpixels 21_1, 21_2, 21_3, 21_4, 21_5, and 21_6, all of the first switches 281*a*, 282*a*, and 283*a* may be turned on. In this case, all of the first grayscale voltages generated by the first group gamma circuit 230*a* may be transmitted to the converter group 220*a*, and may be applied to the first group subpixels 21_1, 21_2, 21_3, 21_4, 21_5, and 21_6 through the source amplifier group 260*a*.

According to an embodiment, the second group gamma circuit 240*a* may generate a plurality of second grayscale voltages based on the gamma reference voltages received from the gamma adjustment circuits 271*a*, 272*a*, and 273*a*. The intensity of the second grayscale voltage may have different values based on a single binary bit. The intensity of the second grayscale voltage may be controlled by the controller 250.

According to an embodiment, the second switches 291*a*, 292*a*, and 293*a* may be included at the output terminal of the second group gamma circuit 240*a*. The second switches 291*a*, 292*a*, and 293*a* may be, for example, the second group switches 241_1 to 241_*n* shown in FIG. 2.

According to an embodiment, when image data is transmitted to the first group subpixels 21_1, 21_2, 21_3, 21_4, 21_5, and 21_6, all of the second switches 291*a*, 292*a*, and 293*a* may be turned off. In this case, the second grayscale voltage generated by the second group gamma circuit 240*a* may not be applied to the first group subpixels 21_1, 21_2, 21_3, 21_4, 21_5, and 21_6.

According to an embodiment, output values of the first gamma circuits 231*a*, 232*a*, and 233*a* included in the first group gamma circuit 230*a* may be shared with each other. For example, a sharing switch may be additionally provided, which allows the output voltages to be shared between the output terminal of the first red gamma circuit 231*a*, the output terminal of the first green gamma circuit 232*a*, and the output terminal of the first blue gamma circuit 233*a*. In this case, for example, a output value of the first red gamma circuit 231*a* may be connected to the output terminal of the first green gamma circuit 232*a* or the output terminal of the first blue gamma circuit 233*a* by the sharing switch, and the output value of the first red gamma circuit 231*a* may be transmitted to the green subpixels 21_2 and 21_5 or the blue subpixels 21_3 and 21_6. In this case, the first switch 282*a* or 283*a* or the first reference switch 322*a* or 323*a* connected to the first green gamma circuit 232*a* or the first blue gamma circuit 233*a* may be turned off. As a result, a first grayscale voltage may be applied to the first group subpixels 21_1, 21_2, 21_3, 21_4, 21_5, and 21_6 included in the display panel 211 of the first region. The first grayscale voltage may have more various intensities than the second grayscale voltage, and the intensity of light emitted from the first group subpixels 21_1, 21_2, 21_3, 21_4, 21_5, and 21_6 may be more precisely adjusted. Because specified content may be output to the first region, the specified content may be output with a relatively higher image quality.

Figure 3B:
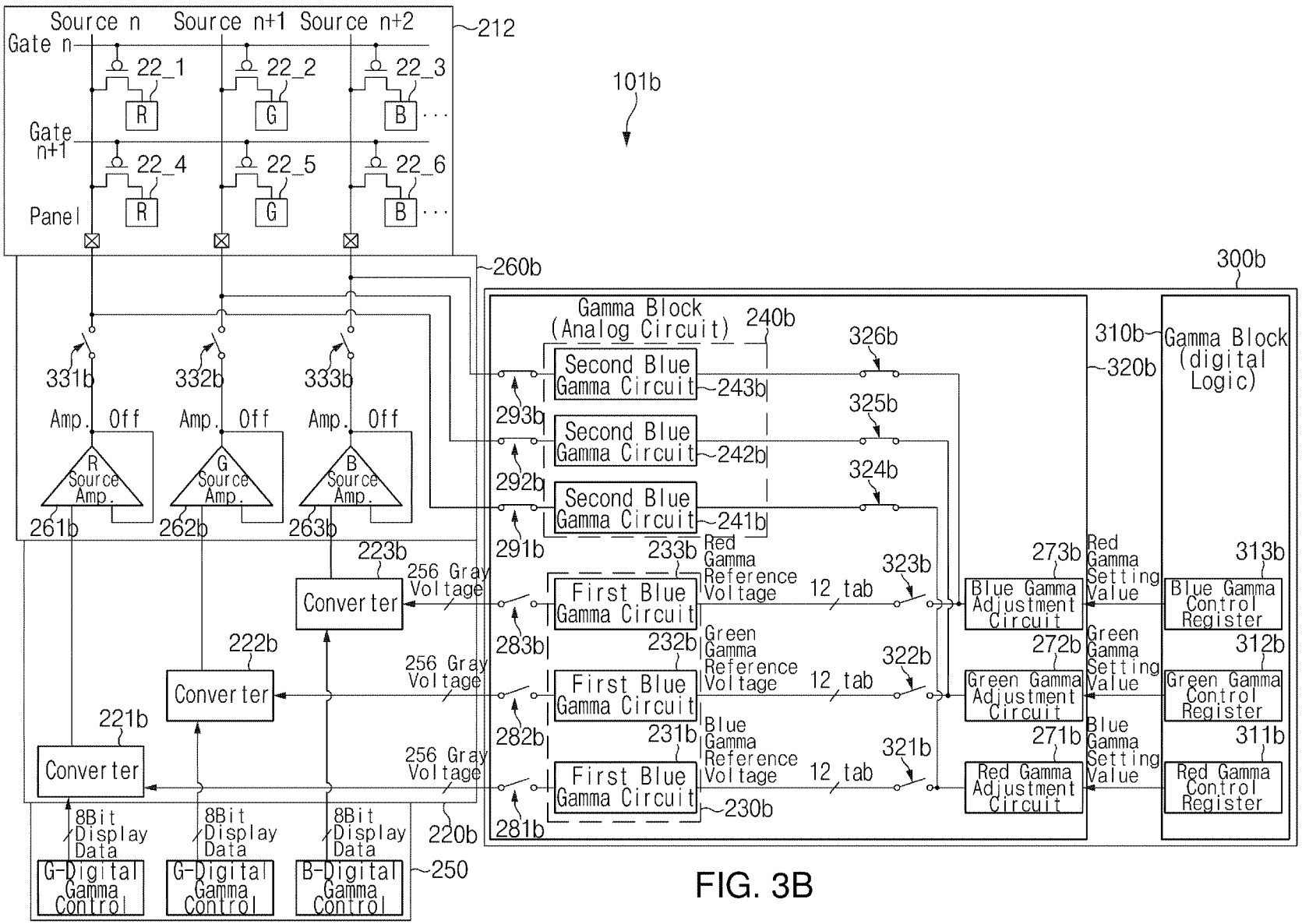
FIG. 3B illustrates a detailed block diagram of a second region of a display, according to an embodiment.

FIG. 3B illustrates a detailed block diagram of a second region of a display, according to an embodiment.

Referring to FIG. 3B, a display 101*b* may include a display panel 212 in a second region, a source amplifier group 260*b*, a converter group 220*b*, the controller 250, and a gamma block 300*b*. The display 101*b* shown in FIG. 3B may include the same or similar components to those of the display 101*a* shown in FIG. 3A, and the description of FIG. 3B may be omitted, which overlaps the description of FIG. 3A. For example, a description for the display panel 212 of the second region shown in FIG. 3B may be replaced with the description for the display panel 211 of the first region shown in FIG. 3A.

According to an embodiment, as shown in FIG. 3B, when image data is transmitted to second group subpixels 22_1, 22_2, 22_3, 22_4, 22_5, and 22_6, first reference switches 321*b*, 322*b*, and 323*b* may be turned off, and second reference switches 324*b*, 325*b*, and 326*b* may be turned on. In this case, the gamma reference voltage may not be transmitted to a first group gamma circuit 230*b*, but may be transmitted to a second group gamma circuit 240*b*. According to an embodiment, the gamma reference voltage to be transferred to the second group gamma circuit 240*b* may have various values. Accordingly, the second grayscale voltage generated by the second group gamma circuit 240*b* may also have various values.

According to another embodiment, as shown in FIG. 3B, when image data is transmitted to the second group subpixels 22_1, 22_2, 22_3, 22_4, 22_5, and 22_6, the first reference switches 321*b*, 322*b*, and 323*b* and the second reference switches 324*b*, 325*b*, and 326*b* may be all turned on. In this case, the gamma reference voltage may be transmitted to both the first group gamma circuit 230*b* and the second group gamma circuit 240*b*.

According to an embodiment, when image data is transmitted to the second group subpixels 22_1, 22_2, 22_3, 22_4, 22_5, and 22_6, all of the first switches 281*b*, 282*b*, and 283*b* may be turned off. In this case, the first grayscale voltage generated by the first group gamma circuit 230*b* may not be transmitted to the converter group 220*b*, and not be also applied to the second group subpixels 22_1, 22_2, 22_3, 22_4, 22_5, and 22_6.

According to an embodiment, when image data is transmitted to the second group subpixels 22_1, 22_2, 22_3, 22_4, 22_5, and 22_6, all of the second switches 291*b*, 292*b*, and 293*b* may be turned on. In this case, the second grayscale voltage generated by the second group gamma circuit 240*b* may be applied to the second group subpixels 22_1, 22_2, 22_3, 22_4, 22_5, and 22_6.

According to an embodiment, output values of the second gamma circuits 241*b*, 242*b*, and 243*b* included in the second group gamma circuit 240*b* may be shared with each other. For example, a sharing switch may be additionally provided, which allows the output voltages to be shared between the output terminal of the second red gamma circuit 241*b*, the output terminal of the second green gamma circuit 242*b*, and the output terminal of the second green gamma circuit 243*b*. In this case, for example, an output value of the second red gamma circuit 241*b* may be connected to the output terminal of the second green gamma circuit 242*b* or the output terminal of the second blue gamma circuit 243*b* by the sharing switch and an output value of the second red gamma circuit 241*b* may be transmitted to the green subpixels 22_2 and 22_5 or the blue subpixels 22_3 and 22_6. In this case, the second switch 292*b* or 293*b* or the second reference switch 325*b* or 326*b* connected to the second green gamma circuit 242*b* or the second blue gamma circuit 243*b* may be turned off.

According to an embodiment, when a specified source voltage is applied to the second group subpixels 22_1, 22_2, 22_3, 22_4, 22_5, and 22_6, all or some of the plurality of source amplifiers 261*b*, 262*b*, and 263*b* may be turned off. In one embodiment, all or some of switches 331*b*, 332*b*, and 333*b* disposed at the output terminals of the plurality of source amplifiers 261*b*, 262*b*, and 263*b* may also be turned off. In this case, image data is not transmitted to the second group subpixels 22_1, 22_2, 22_3, 22_4, 22_5, and 22_6, and only the second grayscale voltage may be applied to the second group subpixels 22_1, 22_2, 22_3, 22_4, 22_5, and 22_6 to express a specified color.

As a result, the second grayscale voltage may be applied to the second group subpixels 22_1, 22_2, 22_3, 22_4, 22_5, and 22_6 included in the display panel 212 of the second region. Because the second grayscale voltage may have a less number of intensities than the first grayscale voltage, the second group gamma circuit 240*b* that generates the second grayscale voltage may consume less power than the first group gamma circuit 230*b*. When outputting a screen of the second region, the display 101*b* may reduce power consumption by using the second group gamma circuit 240*b*. According to an embodiment, as mentioned above, all or some of the switches 331*b*, 332*b*, and 333*b* disposed at the output terminals of the plurality of source amplifiers 261*b*, 262*b*, and 263*b* may be turned off, and in this case, power consumed by the display 101*b* may be further reduced.

Figure 4:
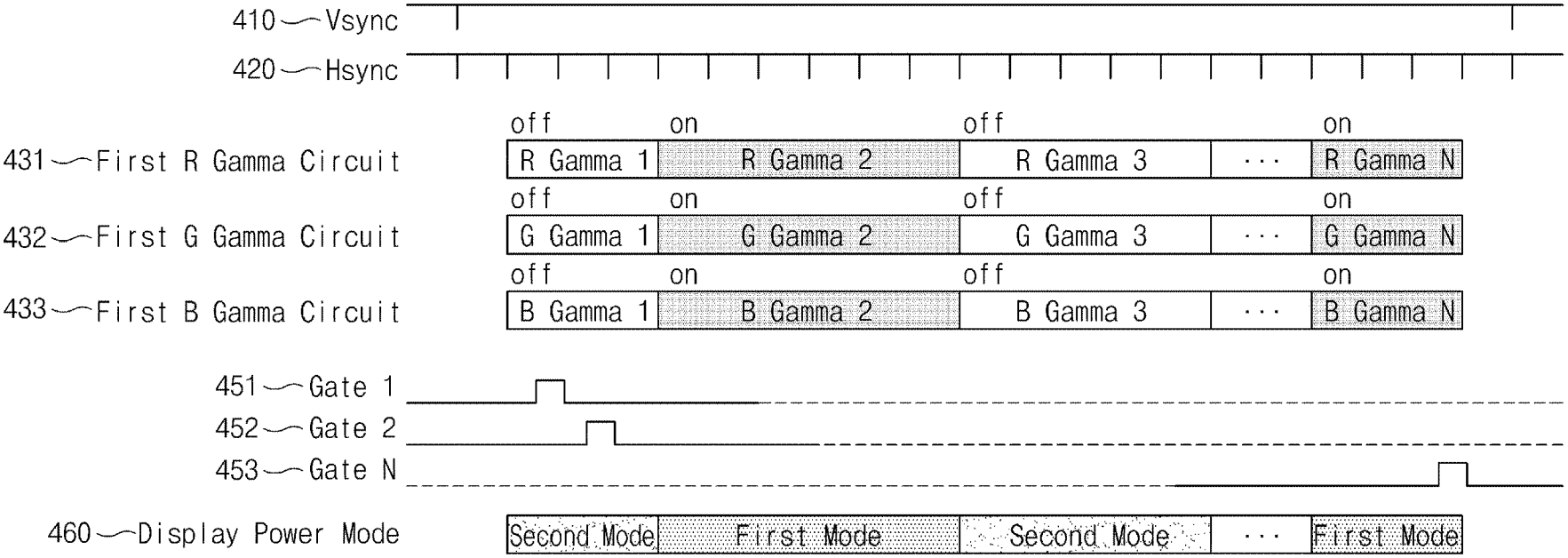
FIG. 4 illustrates an operation timing diagram of a display according to an embodiment.

FIG. 4 illustrates an operation timing diagram of a display according to an embodiment.

Referring to FIG. 4, a timing diagram can be seen, which represents that image data is transmitted to a display panel (e.g., the display panel 210 of FIG. 2) and output on a screen with lapse of time. The graphs shown in FIG. 4 may be timing diagrams for output of the display 101 included in the electronic device 100 shown in FIG. 1, for example.

According to an embodiment, the image data may be sequentially transferred to subpixels (e.g., the subpixels 21_1 to **21_*n* and 22_1 to 22_*n* of FIG. 2**) included in a display panel with lapse of time. The subpixels may sequentially emit light in response to the reception of the image data, and specified content may be output to the display.

A vertical synchronization graph 410 may represent a vertical synchronization signal that synchronizes outputs from the top to the bottom of the display. According to an embodiment, the image data may be output as one frame on the display every period of the vertical synchronization signal.

A horizontal synchronization graph 420 may represent a horizontal synchronization signal that synchronizes outputs for one horizontal line of the display. The image data may be transferred to subpixels included in one gate line of the display every period of the horizontal synchronization signal. According to an embodiment, one period of the vertical synchronization signal may include a plurality of periods of the horizontal synchronization signal. Therefore, the image data may be sequentially output for each gate line based on the vertical synchronization signal during the time when the vertical synchronization signal is activated.

For example, referring to FIG. 1, image data may be output, for each gate line based on the vertical synchronization signal, to the first region 11*a* after being output to the second region 12*a*, may be output to the second region 12*b* after being output to the first region 11*a*, and may be output to the first region 11*b* after being output to the second region 12*b*. For another example, the image data may be output, for each gate line based on the vertical synchronization signal, to the second region 12*b* after being output to the first region 11*b*, may be output to the first region 11*a* after being output to the second region 12*b*, and may be output to the second region 12*a* after being output to the first region 11*a*.

Gate graphs 451, 452, and 453 may represent gate lines that are activated based on the horizontal synchronization signal. For example, referring to the gate graphs 451, 452, and 453, it can be seen that the first gate line to the N-th gate line are sequentially activated. According to an embodiment, when the first gate line is activated, a source voltage may be applied to subpixels included in the first gate line, and when the N-th gate line is activated, a source voltage may be applied to subpixels included in the N-th gate line.

First gamma circuit graphs 431, 432, and 433 may indicate whether a first red gamma circuit (e.g., the first red gamma circuit 231*a* of FIG. 3A), a first green gamma circuit (e.g., the first green gamma circuit 232*a* of FIG. 3A), and a first blue gamma circuit (e.g., the first blue gamma circuit 233*a* of FIG. 3A) included in a first gamma circuit (e.g., the first group gamma circuit 230*a* of FIG. 3A) are activated. In one embodiment, the activation of the gamma circuits may be understood as the first group switches 281*a*, 282*a*, and 283*a* shown in FIG. 3A being turned on, and the deactivation of the gamma circuits may be understood as the first group switches 281*a*, 282*a*, and 283*a* being turned off. Referring to the first gamma circuit graphs 431, 432, and 433, the first red gamma circuit, the first green gamma circuit, and the first blue gamma circuit may be repeatedly activated or deactivated during a specified time.

For example, while the second regions 12*a* and 12*b* are output in FIG. 1, the first red gamma circuit, the first green gamma circuit, and the first blue gamma circuit may all be deactivated, and while the first regions 11*a* and 11*b* are output, the first red gamma circuit, the second green gamma circuit, and the third green gamma circuit may all be activated.

According to one embodiment, a controller (e.g., the controller 250 of FIG. 2) may selectively turn on/off first group switches connected to the output terminal of the first group gamma circuit and second group switches connected to the output terminal of the second group gamma circuit. In other words, the controller may selectively activate the first group gamma circuit and the second group gamma circuit. Therefore, in the first gamma circuit graph, the second gamma circuit may be activated during the time when the first gamma circuit is deactivated, and the second gamma circuit may be deactivated during the time during which the first gamma circuit is activated.

A display power mode graph 460 may represent a change in a method in which a grayscale voltage is applied to the display with elapse of time. In one embodiment, a first mode may indicate a case in which the first grayscale voltage is applied to the subpixels by the first gamma circuit. A second mode may indicate a case in which the second grayscale voltage is applied to the subpixels by the second gamma circuit. According to an embodiment, the second mode may have a relatively small amount of power consumption compared to the first mode.

Figure 5:
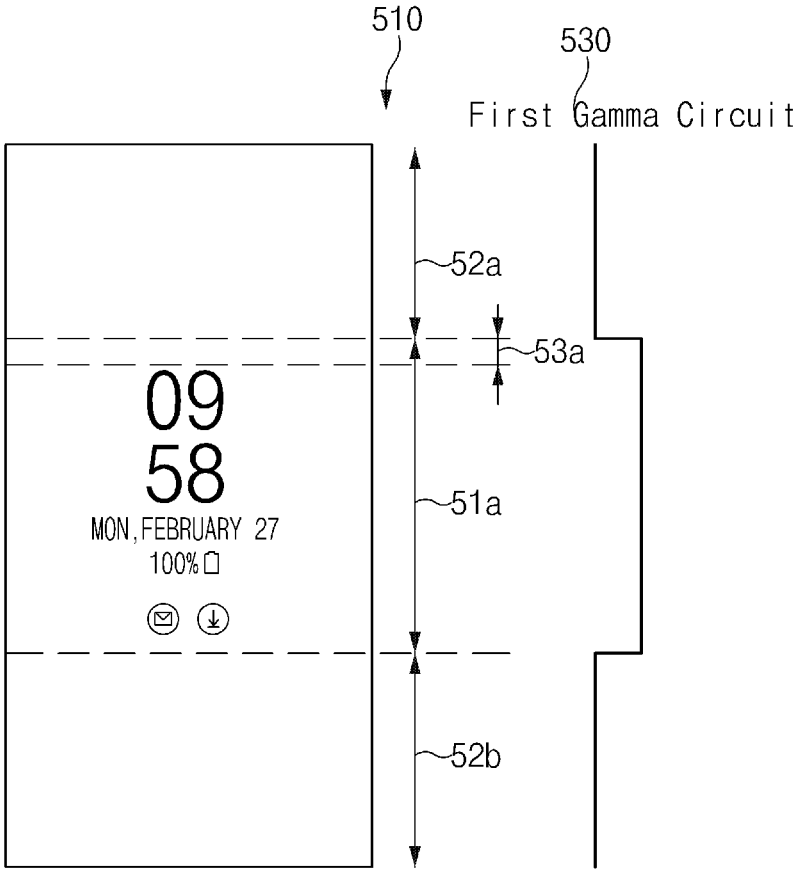
FIG. 5 illustrates a display screen and an operation timing diagram according to an embodiment.

FIG. 5 illustrates a display screen and an operation timing diagram according to an embodiment.

Referring to FIG. 5, a display screen 510 of the electronic device 100 being in the AOD state includes a first region 51*a* that outputs specified content and second regions 52*a* and 52*b* that do not output the specified content. According to various embodiments, the display screen 510 may include one of the first region 51*a* and the second area 52*a* or 52*b* or include some of the first region 51*a* and the second regions 52*a* and 52*b*

According to an embodiment, the first region 51*a* and the second regions 52*a* and 52*b* may be divided by a virtual line parallel to the gate line. The gate line may be a line composed of a plurality of subpixels to which a gate voltage is applied at the same time.

According to various embodiments, the gate line may be parallel to a transversal line of the electronic device as shown in FIG. 5, or may be parallel to a longitudinal line of the electronic device unlike what is shown in FIG. 5.

According to an embodiment, a display (e.g., the display 101 of FIG. 2) may include at least one gate line, and the gate voltage may be applied to the at least one gate line at a specified time interval for each gate line. The specified time interval may be determined by the graph 420 of the vertical synchronization signal shown in FIG. 4.

According to an embodiment, the gate voltage may be sequentially applied in a direction from gate lines included in the second region 52*a* to gate lines included in the first region 51*a*. In this case, it may be configured that the specified content may not be output to subpixels included in at least one gate line adjacent to the second region 52*a* among the gate lines included in the first region 51*a*.

For example, in the display screen 510 shown in FIG. 5, the gate line may be parallel to the longitudinal line of the electronic device 100, and the gate voltage is sequentially applied in a direction from a gate line disposed on the upper side to a gate line disposed on the lower side. In this case, at least one gate line may be disposed in a third region 53*a* of the first region 51*a*, adjacent to the second region 52*a*, and a screen made of single color (e.g., black) rather than the specified content may be output to the third region 53*a*. According to an embodiment, the third region 53*a* may be understood as a portion of the first region 51*a* adjacent to the end point of the second region 52*a* and including the start point of the first region 51*a* in the display output in a direction from the second region 52*a* to the first region 51*a*.

Referring to FIG. 5, it can be seen that a first gamma circuit graph 530 is shown in parallel with the display screen 510. The first gamma circuit graph 530 may indicate whether the first gamma circuit (e.g., the first group gamma circuit 230 of FIG. 2) according to the regions 51*a*, 52*a*, and 52*b* of the display screen 510 is activated. According to an embodiment, the first gamma circuit may be activated at an output time point at which the first region 51*a* is output after the output of the second region 52*a*.

In outputting the first region 51*a* using the first gamma circuit, when specified content having various colors is output after outputting the third region 53*a* including a single color screen, as shown in FIG. 5, the burden by driving of the first gamma circuit may be reduced. In other words, the first gamma circuit may be more stably driven by outputting a single color before output of specified content requiring output of various colors.

Figure 6:
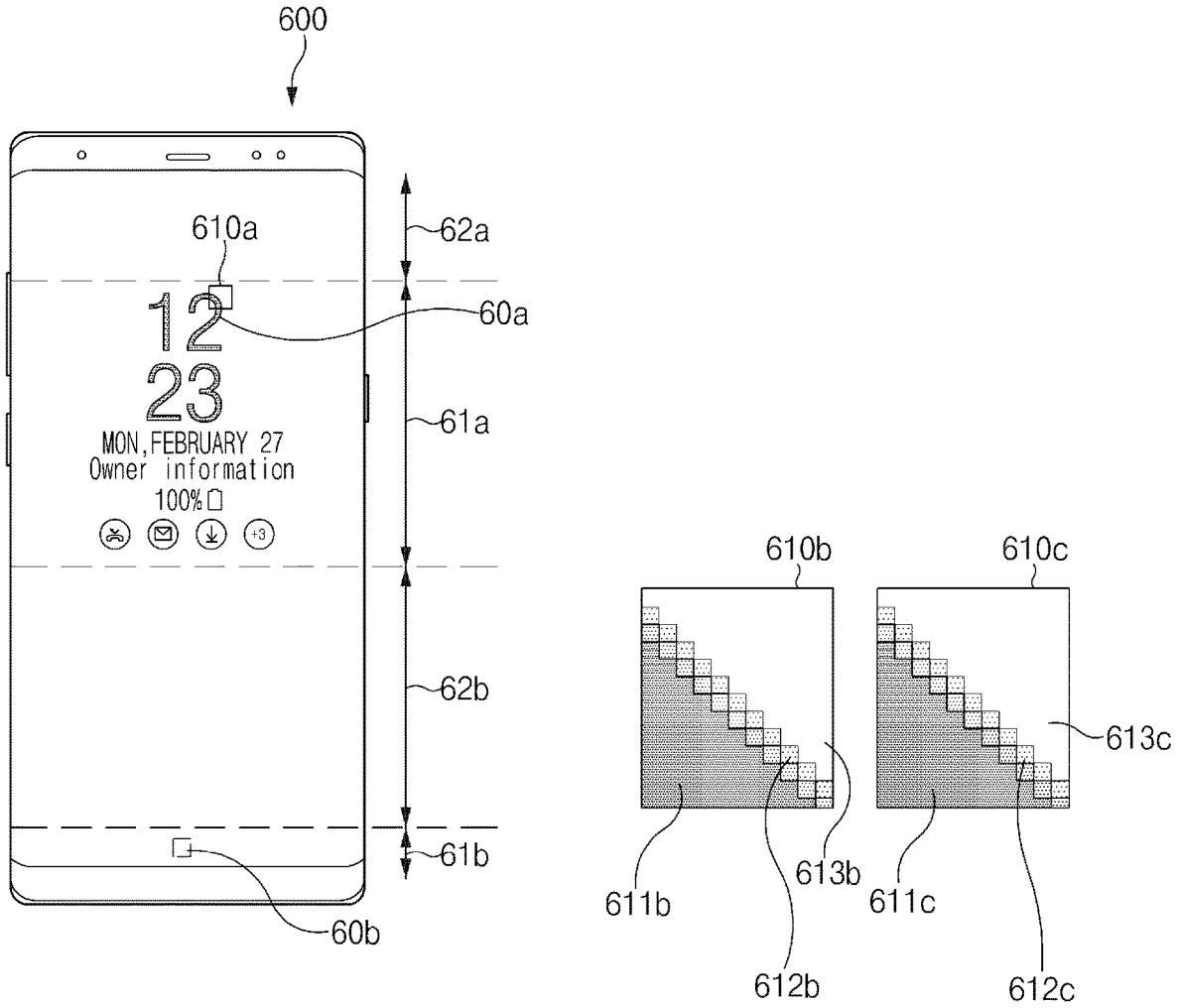
FIG. 6 illustrates a front view and an enlarged view of an electronic device being in an AOD state, according to an embodiment.

FIG. 6 illustrates a front view and an enlarged view of an electronic device being in an AOD state, according to an embodiment.

Referring to FIG. 6, a display of an electronic device 600 being in an AOD state may include first regions 61*a* and 61*b* that output pieces of content 60*a* and 60*b* and second regions 62*a* and 62*b* that do not output the pieces of content 60*a* and 60*b*. According to various embodiments, the number of the pieces of content 60*a*, 60*b* may be at least one, and the number of the first regions 61*a* and 61*b* and the number of the second regions 62*a* and 62*b* may be at least one or more according to the number of the pieces of content.

According to an embodiment, a first grayscale voltage may be applied to some of subpixels disposed in the at least one of the first regions 61*a* and 61*b*, and a second grayscale voltage may be applied to the other some thereof. For example, subpixels disposed in the first regions 61*a* and 61*b* may include a red subpixel, a green subpixel, and a blue subpixel. The first grayscale voltage may be applied to the red subpixel and the green subpixel of the subpixels, and a second grayscale voltage may be applied to the blue subpixel. For another example, the first grayscale voltage may be applied to the red subpixel of the subpixels, and the second grayscale voltage may be applied to the green subpixel and the blue subpixel. According to various embodiments, the subpixel to which the first grayscale voltage is applied and the subpixel to which the second grayscale voltage is applied may be grouped in various combinations and are not limited to the above embodiment.

Hereinafter, in the description with reference to FIG. 6, the electronic device 600 shown in FIG. 6 may be described as applying the first grayscale voltage to the red subpixel and the green subpixel and the second grayscale voltage to the blue subpixel.

Referring to FIG. 6, a first enlarged view 610*b* and a second enlarged view 610*c* in which a portion of a region where the first content 60*a* is output is enlarged are illustrated. According to an embodiment, the first enlarged view 610*b* may represent an embodiment in which a first grayscale voltage is applied to all of the red subpixel, the green subpixel, and the blue subpixel. The second enlarged view 610*c* may represent an embodiment in which a first grayscale voltage is applied to the red subpixel and the green subpixel, and a second grayscale voltage is applied to the blue subpixel.

Referring to the first enlarged view 610*b* and the second enlarged view 610*c*, regions in which the first content 60*a* is output may include a main region 611*b* or 611*c*, a sub region 612*b* or 612*c*, and a background region 613*b* or 613*c*. The main region 611*b* or 611*c* may be understood as a region in which a specified color of the first content 60*a* is output. The background region 613*b* or 613*c* may be a portion of the first region 61*a*, in which the first content 60*a* is not output and a single specified color (e.g., black) is output. The sub region 612*b* or 612*c* may be a region for expressing a soft and natural boundary by outputting an intermediate color between the main region 611*b* or 611*c* and the background region 613*b* or 613*c*.

According to an embodiment, RGB values R, G, and B of the first main region 611*b* of the first enlarged view 610*b* may be (Rm1, Gm1, Bm1), and RGB values for the first sub region 612*b* may be (Rs1, Gs1, Bs1). RGB values for the second main region 611*c* of the second enlarged view 610*c* may be (Rm2, Gm2, Bm2) and RGB values for the second sub region 612*c* may be (Rs2, Gs2, Bs2).

According to an embodiment, because colors represented by the first main region 611*b* and the second main region 611*c* are the same, Rm1 and Rm2 may have the same value, Gm1 and Gm2 may have the same value, and Bm1 and Bm2 may have the same value.

According to an embodiment, a color represented by the first main region 611*b* and a color represented by the first sub region 612*b* may be different. Therefore, Rm1 and Rs1 may have different values, Gm1 and Gs1 may have different values, and Bm1 and Bs1 may also have different values.

According to an embodiment, a color represented by the second main region 611*c* and a color represented by the second sub region 612*c* may be different. However, the second grayscale voltage is applied to the blue subpixel in the second enlarged view 610*c*, and therefore, the blue value may be fixed to a single value. Therefore, Bm2 and Bs2 may have the same value, Rm2 and Rs2 may have different values, and Gm2 and Gs2 may also have different values.

According to an embodiment, a color represented by the second sub region 612*c* may be set to be similar to a color represented by the first sub region 612*b*. For example, values of (Rs2, Gs2, Bs2) may be set such that a color represented by (Rs2, Gs2, Bs2) for the second sub region 612*c* is similar to a color represented by (Rs1, Gs1, Bs1) for the first sub region 612*b*. For example, RGB values for each of the sub regions may be converted into YUV domains. In one embodiment, a Y value of the first sub region 612*b* and a Y value of the second sub region 612*c* may be set to be equal to each other.

According to an embodiment, the RGB values for the second sub region 612*c* may be determined based on RGB values for the second main region 611*c* and RGB values for the first sub region 612*b*. For example, among RGB values for the second sub region 612*c*, a value for a subpixel to which the second grayscale voltage is applied may be determined as RGB values for the second main region 611*c*, and a value for a subpixel to which the first grayscale voltage is applied may be determined by a specified equation based on the RGB values for the second main region 611*c* and the RGB values for the first sub region 612*b*.

In one embodiment, the value of Bs2 may be set to the value of Bm2 as mentioned above. According to one embodiment, the value of Rs2 and the value of Gs2 may be set by the specified equation based on the RGB values (Rs1, Gs1, Bs1) for the first sub region 612*b* and the fixed value of Bs2 for the second sub region 612*c*. For example, Rs2 may be set to Rs1−(Bs2−Bs1)/6, and Gs2 may be set to Gs1−(Bs2−Bs1)/12. According to an embodiment, the specified equation is not limited to the above-mentioned embodiment and may be variously set.

When the first grayscale voltage and the second grayscale voltage are applied to the second sub region 612*c* according to the determined values of (Rs2, Gs2, Bs2), the first content 60*a* may be output similarly to a case where only the first grayscale voltage is applied and may accomplish further reduction in power consumption, compared to a case where only the first grayscale voltage is applied.

Figure 7A:
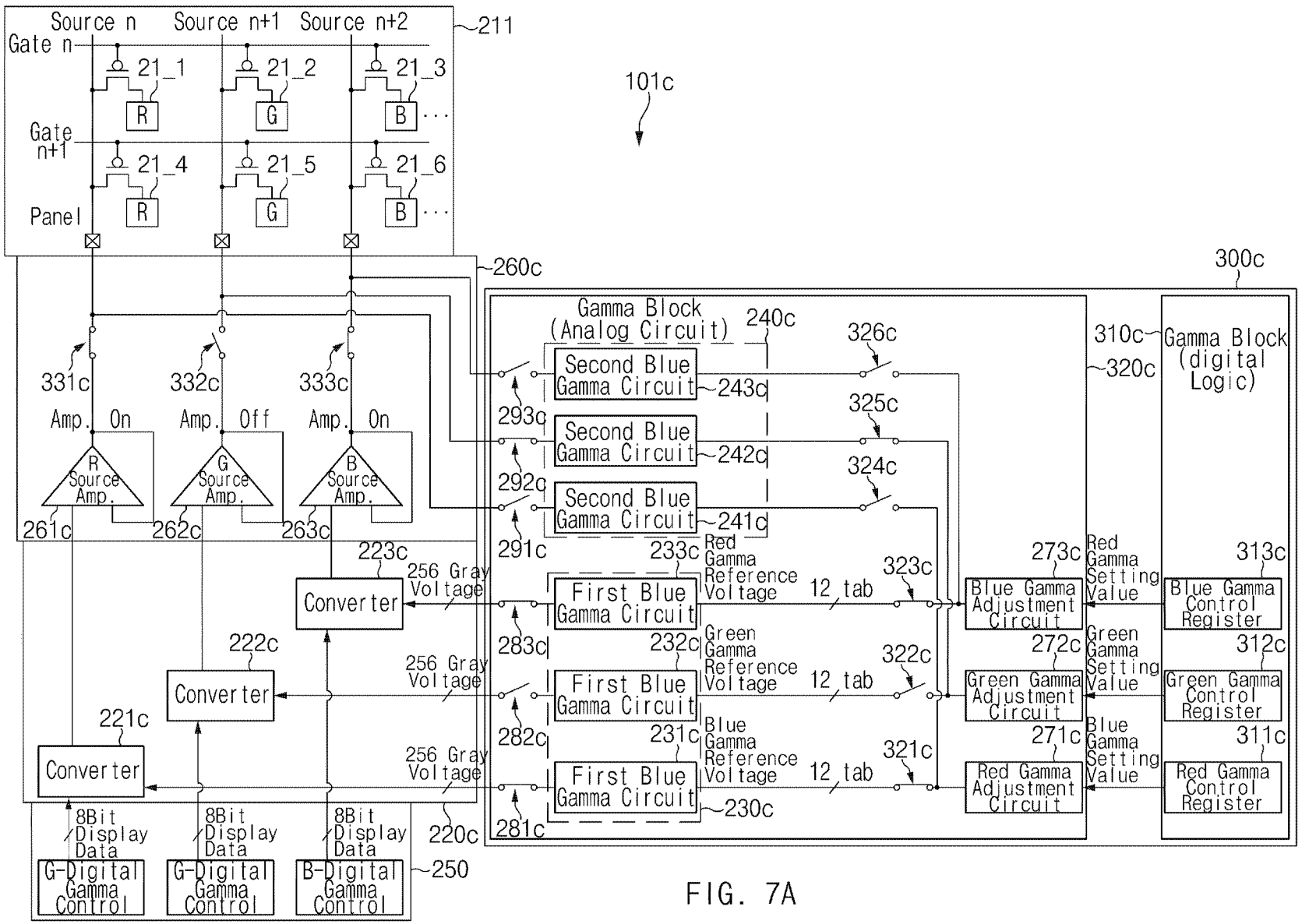
FIG. 7A illustrates a detailed block diagram of a first region of a display according to another embodiment.

FIG. 7A illustrates a detailed block diagram of a first region of a display according to another embodiment.

Referring to FIG. 7A, a display 101*c* may include a display panel 211 of a first region, a source amplifier group 260*c*, a converter group 220*c*, the controller 250, and a gamma block 300*c*. The display 101*c* shown in FIG. 7A may include the same or similar components as those of the display 101*a* shown in FIG. 3A, and the description with reference to FIG. 7A may be omitted, which overlaps with the description with reference to FIG. 3A.

The display 101*c* shown in FIG. 7A may represent, for example, a display included in the electronic device 600 shown in FIG. 6. However, while it is described with reference to FIG. 6 that the second grayscale voltage is applied to the blue subpixel included in the first region, the display 101*c* shown in FIG. 7A may be understood as the second grayscale voltage being applied to the green subpixels 21_2 and 21_5 included in the first region.

According to an embodiment, a first group gamma circuit 230*c* may apply the first grayscale voltage to at least some of converters of the converter group 220*c*. For example, the controller 250 may connect the first group gamma circuit 230*c* with the at least some converters. For example, the controller 250 may connects a converter 221*c* electrically connected to the red subpixels 21_1 and 21_4 with a first red gamma circuit 231*c* of the first group gamma circuit 230*c*, and connect a converter 223*c* electrically connected to the blue subpixel 21_3 and 21_6 with a first blue gamma circuit 233*c*.

In this case, the second grayscale voltage may be applied to subpixels connected to the remaining converters except the at least some converters. For example, the controller may connect a second group gamma circuit 240*c* with the subpixels connected to the remaining converters. For example, the controller 250 may connect the green subpixels 21_2 and 21_5 with a second green gamma circuit 242*c*.

According to an embodiment, when the second grayscale voltage is applied to the at least some subpixels, all or some of source amplifiers connected to the subpixels may be turned off. In one embodiment, all or some of switches disposed at output terminals of the source amplifiers may also be turned off. For example, when the second grayscale voltage is applied to the green subpixels 21_2 and 21_5, a green source amplifier 262*c* may be turned off and a switch 332*c* disposed at an output terminal of the green source amplifier 262*c* may also be turned off. In this case, image data is not transmitted to the green subpixels 21_2 and 21_5, and only the second grayscale voltage may be applied to the green subpixels 21_2 and 21_5 to express a specified color.

Through this, the second grayscale voltage may be applied to one subpixel of the subpixels 21_1, 21_2, 21_3, 21_4, 21_5, and 21_6 included in the first region, for example, the green subpixels 21_2 and 21_5 and the first grayscale voltage may be applied to the remaining subpixels 21_1, 21_3, 21_4, and 21_6. Although not shown in FIG. 7A, the second grayscale voltage may be applied to subpixels included in the second region (e.g., 22_1, 22_2, 22_3, 22_4, 22_5, and 22_6 of FIG. 3B).

In this case, power consumption in the display 101*c* may be relatively reduced compared to a case where the first grayscale voltage is applied to all of the first group subpixels 21_1, 21_2, 21_3, 21_4, 21_5, and 21_6. According to an embodiment, as described above, the source amplifier 262*c* and the switch 332*c* disposed at the output terminal of the source amplifier 262*c* may be turned off, and in this case, power consumption in the display 101*c* may be further reduced.

Figure 7B:
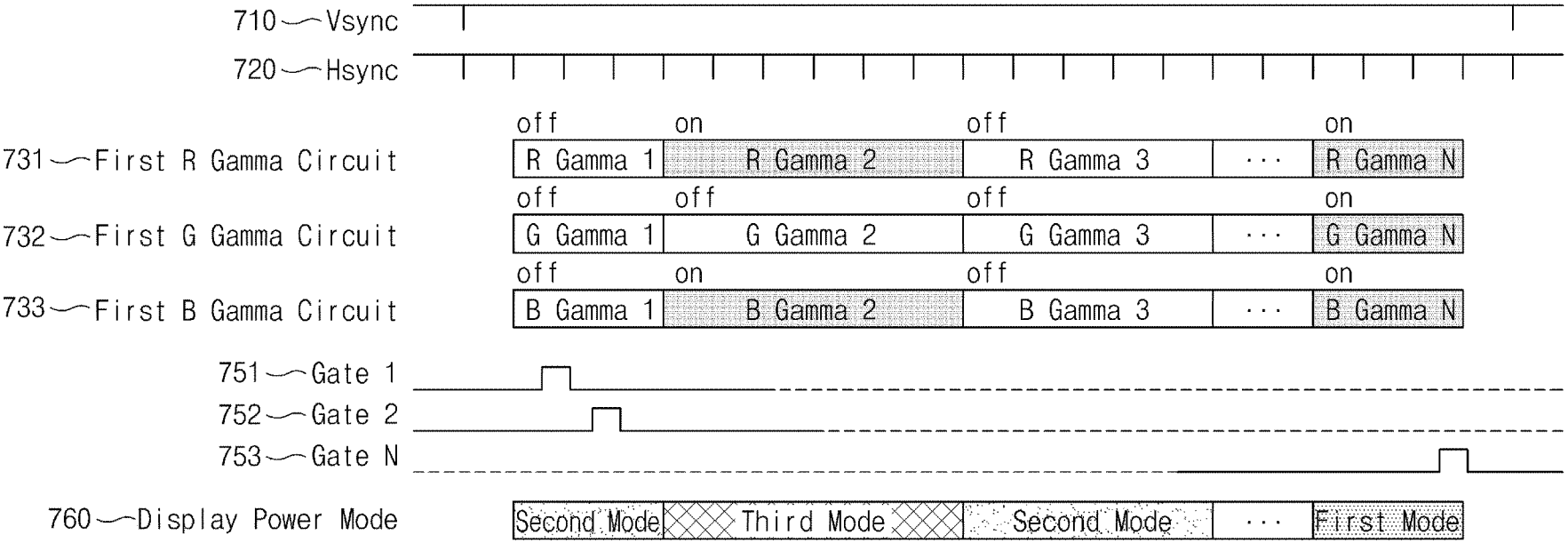
FIG. 7B illustrates an operation timing diagram of a display according to another embodiment.

FIG. 7B illustrates an operation timing diagram of a display according to another embodiment.

Referring to FIG. 7B, there is illustrated a timing diagram indicating that image data is transferred to a display panel and output to a screen with elapse of time. The graphs shown in FIG. 7B may be timing diagrams for output of a display included in the electronic device 600 shown in FIG. 6, for example. However, while it is described with reference to FIG. 6 that the second grayscale voltage is applied to the blue subpixel included in the first region, the graph shown in FIG. 7B may be understood as the second grayscale voltage being applied to green subpixels included in the first region. In the description with reference to FIG. 7B, contents overlapping the description with reference to FIG. 4 may be omitted.

Similarly to FIG. 6, the first green gamma circuit of the first group gamma circuit may be deactivated when the first region including the first content is output. In this case, the second green gamma circuit of the second group gamma circuit may be activated instead of the first green gamma circuit. The second green gamma circuit may apply the second grayscale voltage to the green subpixel included in the first group subpixel.

In display power mode graph 760, a third mode may represent a case in which a part of the first group gamma circuit is deactivated and a part of the second group gamma circuit corresponding to the deactivated first group gamma circuit is activated.

According to an embodiment, the display may be configured to switch the operation mode between the first mode, the second mode, and the third mode. According to an embodiment, the third mode may have a relatively small amount of power consumption compared to the first mode, and may express content of a higher image quality than the second mode, on the display.

Figure 8A:
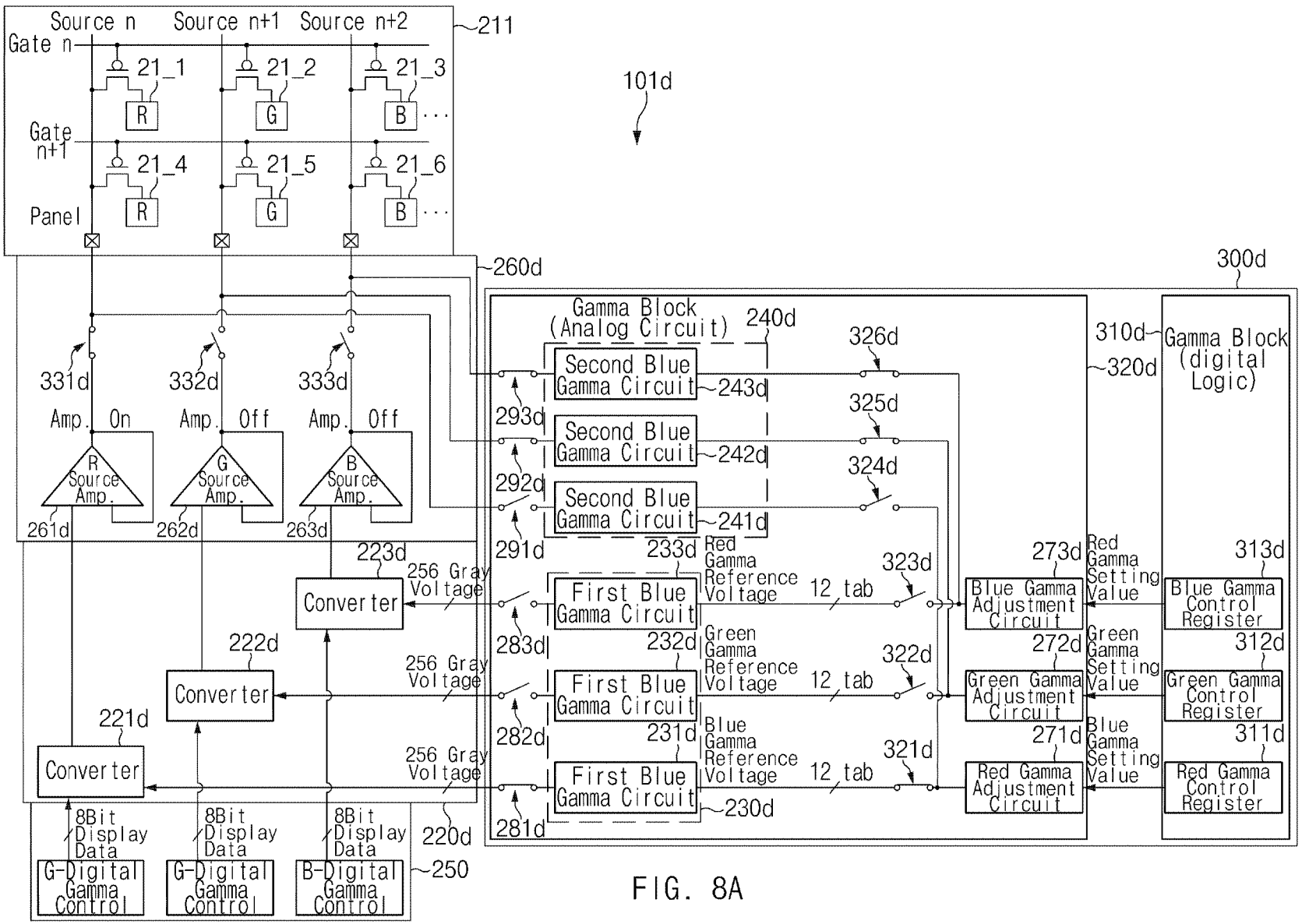
FIG. 8A illustrates a detailed block diagram of a first region of a display according to still another embodiment.

FIG. 8A illustrates a detailed block diagram of a first region of a display according to still another embodiment.

Referring to FIG. 8A, a display 101*d* may include the display panel 211 of the first region, a source amplifier group 260*d*, a converter group 220*d*, the controller 250, and a gamma block 300*d*. The display 101*d* shown in FIG. 8A may include the same or similar components as those of the display 101*a* shown in FIG. 3A, and the description with reference to FIG. 8A may be omitted, which overlaps with the description with reference to FIG. 3A.

The display 101*d* shown in FIG. 8A may represent, for example, a display included in the electronic device 600 shown in FIG. 6. However, while it is described with reference to FIG. 6 that the second grayscale voltage is applied to the blue subpixel included in the first region, the display 101*d* shown in FIG. 8A may be understood as the second grayscale voltage is applied to the green subpixels 21_2 and 21_5 and the blue subpixels 21_3 and 21_6 included in the first region.

According to an embodiment, a first group gamma circuit 230*d* may apply the first grayscale voltage to at least some of converters of the converter group 220*d*. For example, the controller 250 may connect the first group gamma circuit 230*d* with the at least some converters. For example, the controller 250 may connect a converter 221*d* electrically connected to the red subpixels 21_1 and 21_4 with a first red gamma circuit 281*d* of the first group gamma circuit 230*d*.

In this case, the second grayscale voltage may be applied to subpixels connected to the remaining converters except the at least some converters. For example, the controller 250 may connect a second group gamma circuit 240*d* with subpixels connected to remaining converters 222*d* and 223*d*. For example, the controller 250 may connect the green subpixels 21_2 and 21_5 with a second green gamma circuit 242*d* and the blue subpixels 21_3 and 21_6 with a second blue gamma circuit 243*d*.

According to an embodiment, when the second grayscale voltage is applied to the at least some subpixels, all or some of source amplifiers connected to the subpixels may be turned off. In one embodiment, all or some of switches disposed at output terminals of the source amplifiers may also be turned off. For example, when the second grayscale voltage is applied to the green subpixels 21_2 and 21_5 and the blue subpixels 21_3 and 21_6, a green source amplifier 262*d* and a blue source amplifier 263*d* may be turned off. The switches 332*d* and 333*d* disposed at the output terminals of the green source amplifier 262*d* and the blue source amplifier 263*d* may also be turned off. In this case, image data is not transmitted to the green subpixels 21_2 and 21_5 and the blue subpixels 21_3 and 21_6, and only the second grayscale voltage may be applied to the green subpixels 21_2 and 21_5 and the blue subpixels 21_3 and 21_6 to express a specified color.

Through this, the second grayscale voltage may be applied to two subpixels among the subpixels 21_1, 21_2, 21_3, 21_4, 21_5, and 21_6 included in the first region, for example, the green subpixels 21_2 and 21_5 and the blue subpixels 21_3 and 21_6 and the first grayscale voltage may be applied to the red subpixels 21_1 and 21_4. Although not shown in FIG. 8A, the second grayscale voltage may be applied to subpixels included in the second region (e.g., 22_1, 22_2, 22_3, 22_4, 22_5, and 22_6 in FIG. 3B).

In this case, power consumption in the display 101*d* may be relatively reduced compared to a case where the first grayscale voltage is applied to all of the first group subpixels 21_1, 21_2, 21_3, 21_4, 21_5, and 21_6. According to an embodiment, as described above, the source amplifiers 262*d* and 263*d* and the switches 332*d* and 333*d* disposed at the output terminals of the source amplifiers 262*d* and 263*d* may be turned off, and in this case, power consumption in the display 101*d* may be further reduced.

Figure 8B:
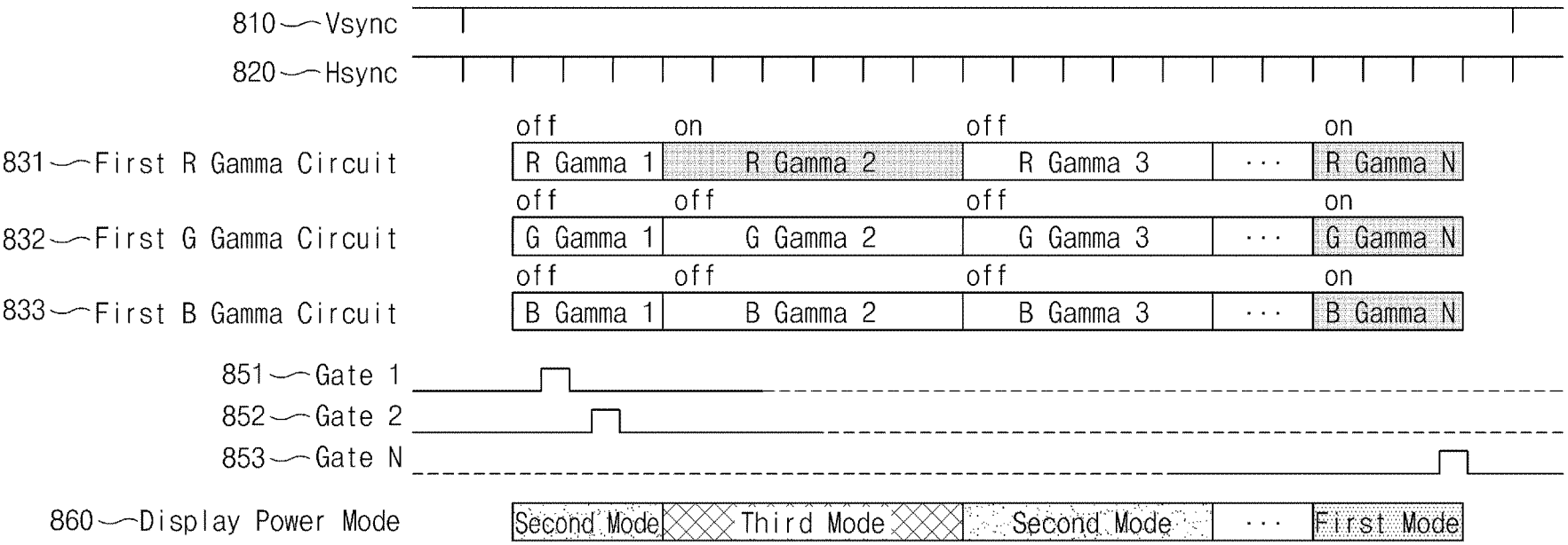
FIG. 8B illustrates an operation timing diagram of a display according to still another embodiment.

FIG. 8B illustrates an operation timing diagram of a display according to still another embodiment.

Referring to FIG. 8B, there is illustrated a timing diagram indicating that image data is transferred to a display panel and output to a screen with elapse of time. The graphs illustrated in FIG. 8B may be timing diagrams for output of a display included in the electronic device 600 illustrated in FIG. 6, for example. However, while it is described with reference to FIG. 6 that the second grayscale voltage is applied to the blue subpixel included in the first region, the graph shown in FIG. 8B may be understood as the second grayscale voltage is applied to green subpixels and blue subpixels included in the first region. In the description with reference to FIG. 8B, contents overlapping the description with reference to FIGS. 4 and 7B may be omitted.

Similarly to FIG. 6, the first green gamma circuit and the first blue gamma circuit of the first group gamma circuit may be deactivated when the first region including the first content is output. In this case, the second green gamma circuit of the second group gamma circuit may be activated instead of the first green gamma circuit, and the second blue gamma circuit of the second group gamma circuit may be activated instead of the first blue gamma circuit. The second green gamma circuit may apply the second grayscale voltage to green subpixels included in the first group subpixels, and the second blue gamma circuit may apply the second grayscale voltage to blue subpixels included in the first group subpixels.

Figure 9:
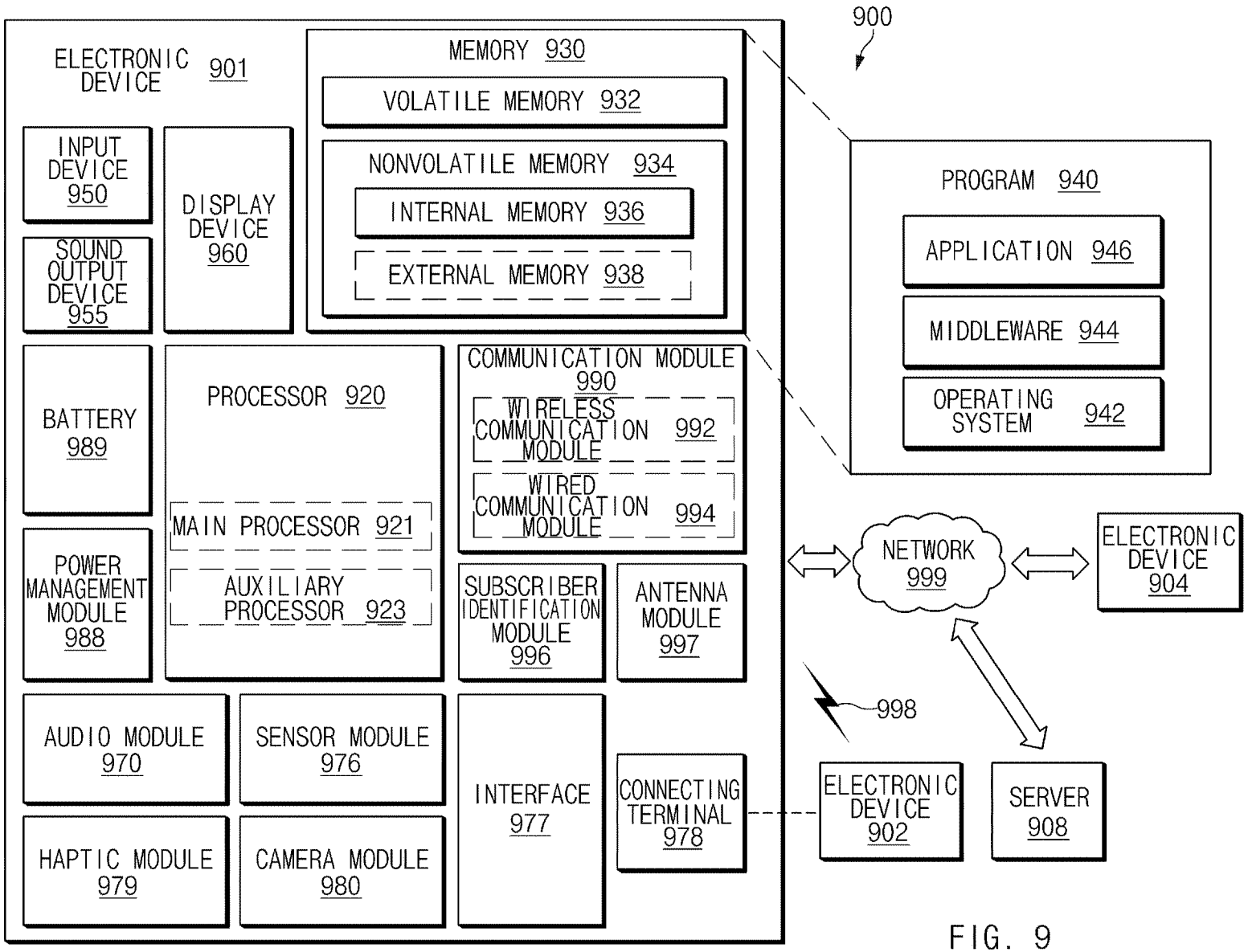
FIG. 9 is a block diagram of an electronic device in a network environment according to various embodiments.

FIG. 9 is a block diagram of an electronic device 901 in a network environment 900 according to various embodiments.

Referring to FIG. 9, an electronic device 901 may communicate with an electronic device 902 through a first network 998 (e.g., a short-range wireless communication) or may communicate with an electronic device 904 or a server 908 through a second network 999 (e.g., a long-distance wireless communication) in a network environment 900. According to an embodiment, the electronic device 901 may communicate with the electronic device 904 through the server 908. According to an embodiment, the electronic device 901 may include a processor 920, a memory 930, an input device 950, a sound output device 955, a display device 960, an audio module 970, a sensor module 976, an interface 977, a haptic module 979, a camera module 980, a power management module 988, a battery 989, a communication module 990, a subscriber identification module 996, and an antenna module 997. According to some embodiments, at least one (e.g., the display device 960 or the camera module 980) among components of the electronic device 901 may be omitted or other components may be added to the electronic device 901. According to some embodiments, some components may be integrated and implemented as in the case of the sensor module 976 (e.g., a fingerprint sensor, an iris sensor, or an illuminance sensor) embedded in the display device 960 (e.g., a display).

The processor 920 may operate, for example, software (e.g., a program 940) to control at least one of other components (e.g., a hardware or software component) of the electronic device 901 connected to the processor 920 and may process and compute a variety of data. The processor 920 may load a command set or data, which is received from other components (e.g., the sensor module 976 or the communication module 990), into a volatile memory 932, may process the loaded command or data, and may store result data into a nonvolatile memory 934. According to an embodiment, the processor 920 may include a main processor 921 (e.g., a central processing unit or an application processor) and an auxiliary processor 923 (e.g., a graphic processing device, an image signal processor, a sensor hub processor, or a communication processor), which operates independently from the main processor 921, additionally or alternatively uses less power than the main processor 921, or is specified to a designated function. In this case, the auxiliary processor 923 may operate separately from the main processor 921 or embedded.

In this case, the auxiliary processor 923 may control, for example, at least some of functions or states associated with at least one component (e.g., the display device 960, the sensor module 976, or the communication module 990) among the components of the electronic device 901 instead of the main processor 921 while the main processor 921 is in an inactive (e.g., sleep) state or together with the main processor 921 while the main processor 921 is in an active (e.g., an application execution) state. According to an embodiment, the auxiliary processor 923 (e.g., the image signal processor or the communication processor) may be implemented as a part of another component (e.g., the camera module 980 or the communication module 990) that is functionally related to the auxiliary processor 923. The memory 930 may store a variety of data used by at least one component (e.g., the processor 920 or the sensor module 976) of the electronic device 901, for example, software (e.g., the program 940) and input data or output data with respect to commands associated with the software. The memory 930 may include the volatile memory 932 or the nonvolatile memory 934.

The program 940 may be stored in the memory 930 as software and may include, for example, an operating system 942, a middleware 944, or an application 946.

The input device 950 may be a device for receiving a command or data, which is used for a component (e.g., the processor 920) of the electronic device 901, from an outside (e.g., a user) of the electronic device 901 and may include, for example, a microphone, a mouse, or a keyboard.

The sound output device 955 may be a device for outputting a sound signal to the outside of the electronic device 901 and may include, for example, a speaker used for general purposes, such as multimedia play or recordings play, and a receiver used only for receiving calls. According to an embodiment, the receiver and the speaker may be either integrally or separately implemented.

The display device 960 may be a device for visually presenting information to the user of the electronic device 901 and may include, for example, a display, a hologram device, or a projector and a control circuit for controlling a corresponding device. According to an embodiment, the display device 960 may include a touch circuitry or a pressure sensor for measuring an intensity of pressure on the touch.

The audio module 970 may convert a sound and an electrical signal in dual directions. According to an embodiment, the audio module 970 may obtain the sound through the input device 950 or may output the sound through an external electronic device (e.g., the electronic device 902 (e.g., a speaker or a headphone)) wired or wirelessly connected to the sound output device 955 or the electronic device 901.

The sensor module 976 may generate an electrical signal or a data value corresponding to an operating state (e.g., power or temperature) inside or an environmental state outside the electronic device 901. The sensor module 976 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 977 may support a designated protocol wired or wirelessly connected to the external electronic device (e.g., the electronic device 902). According to an embodiment, the interface 977 may include, for example, an HDMI (high-definition multimedia interface), a USB (universal serial bus) interface, an SD card interface, or an audio interface.

A connecting terminal 978 may include a connector that physically connects the electronic device 901 to the external electronic device (e.g., the electronic device 902), for example, an HDMI connector, a USB connector, an SD card connector, or an audio connector (e.g., a headphone connector).

The haptic module 979 may convert an electrical signal to a mechanical stimulation (e.g., vibration or movement) or an electrical stimulation perceived by the user through tactile or kinesthetic sensations. The haptic module 979 may include, for example, a motor, a piezoelectric element, or an electric stimulator.

The camera module 980 may shoot a still image or a video image. According to an embodiment, the camera module 980 may include, for example, at least one lens, an image sensor, an image signal processor, or a flash.

The power management module 988 may be a module for managing power supplied to the electronic device 901 and may serve as at least a part of a power management integrated circuit (PMIC).

The battery 989 may be a device for supplying power to at least one component of the electronic device 901 and may include, for example, a non-rechargeable (primary) battery, a rechargeable (secondary) battery, or a fuel cell.

The communication module 990 may establish a wired or wireless communication channel between the electronic device 901 and the external electronic device (e.g., the electronic device 902, the electronic device 904, or the server 908) and support communication execution through the established communication channel. The communication module 990 may include at least one communication processor operating independently from the processor 920 (e.g., the application processor) and supporting the wired communication or the wireless communication. According to an embodiment, the communication module 990 may include a wireless communication module 992 (e.g., a cellular communication module, a short-range wireless communication module, or a GNSS (global navigation satellite system) communication module) or a wired communication module 994 (e.g., an LAN (local area network) communication module or a power line communication module) and may communicate with the external electronic device using a corresponding communication module among them through the first network 998 (e.g., the short-range communication network such as a Bluetooth, a WiFi direct, or an IrDA (infrared data association)) or the second network 999 (e.g., the long-distance wireless communication network such as a cellular network, an internet, or a computer network (e.g., LAN or WAN)). The above-mentioned various communication modules 990 may be implemented into one chip or into separate chips, respectively.

According to an embodiment, the wireless communication module 992 may identify and authenticate the electronic device 901 using user information stored in the subscriber identification module 996 in the communication network.

The antenna module 997 may include one or more antennas to transmit or receive the signal or power to or from an external source. According to an embodiment, the communication module 990 (e.g., the wireless communication module 992) may transmit or receive the signal to or from the external electronic device through the antenna suitable for the communication method.

Some components among the components may be connected to each other through a communication method (e.g., a bus, a GPIO (general purpose input/output), an SPI (serial peripheral interface), or an MIPI (mobile industry processor interface)) used between peripheral devices to exchange signals (e.g., a command or data) with each other.

According to an embodiment, the command or data may be transmitted or received between the electronic device 901 and the external electronic device 904 through the server 908 connected to the second network 999. Each of the electronic devices 902 and 904 may be the same or different types as or from the electronic device 901. According to an embodiment, all or some of the operations performed by the electronic device 901 may be performed by another electronic device or a plurality of external electronic devices. When the electronic device 901 performs some functions or services automatically or by request, the electronic device 901 may request the external electronic device to perform at least some of the functions related to the functions or services, in addition to or instead of performing the functions or services by itself. The external electronic device receiving the request may carry out the requested function or the additional function and transmit the result to the electronic device 901. The electronic device 901 may provide the requested functions or services based on the received result as is or after additionally processing the received result. To this end, for example, a cloud computing, distributed computing, or client-server computing technology may be used.

Figure 10:
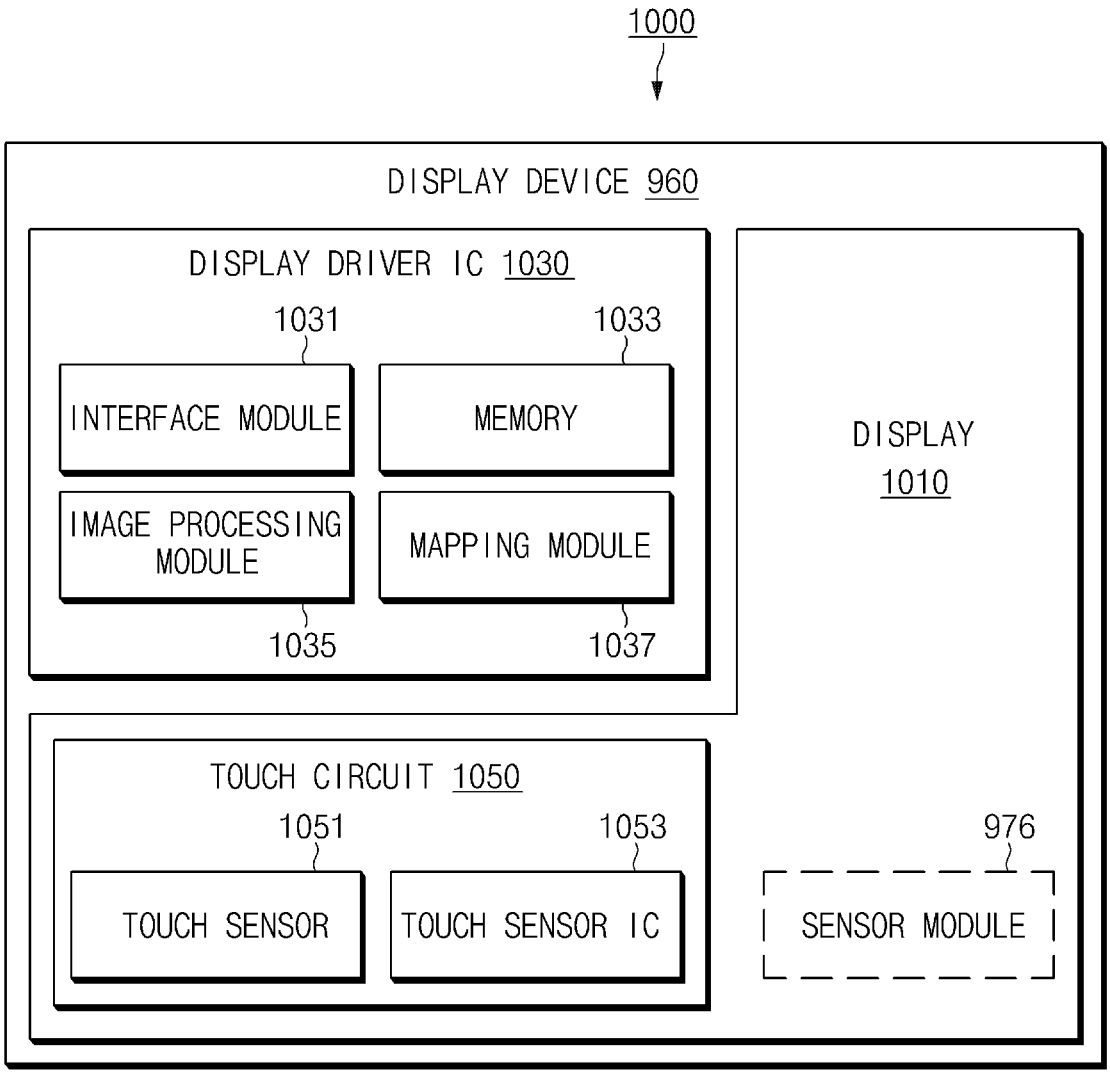
FIG. 10 is a block diagram illustrating the display device according to various embodiments.

FIG. 10 is a block diagram 1000 illustrating the display device 960 according to various embodiments. Referring to FIG. 10, the display device 960 may include a display 1010 and a display driver integrated circuit (DDI) 1030 to control the display 1010. The DDI 1030 may include an interface module 1031, memory 1033 (e.g., buffer memory), an image processing module 1035, or a mapping module 1037. The DDI 1030 may receive image information that contains image data or an image control signal corresponding to a command to control the image data from another component of the electronic device 901 via the interface module 1031. For example, according to an embodiment, the image information may be received from the processor 920 (e.g., the main processor 921 (e.g., an application processor)) or the auxiliary processor 923 (e.g., a graphics processing unit) operated independently from the function of the main processor 921. The DDI 1030 may communicate, for example, with touch circuitry 950 or the sensor module 976 via the interface module 1031. The DDI 1030 may also store at least part of the received image information in the memory 1033, for example, on a frame by frame basis.

The image processing module 1035 may perform pre-processing or post-processing (e.g., adjustment of resolution, brightness, or size) with respect to at least part of the image data. According to an embodiment, the pre-processing or post-processing may be performed, for example, based at least in part on one or more characteristics of the image data or one or more characteristics of the display 1010.

The mapping module 1037 may generate a voltage value or a current value corresponding to the image data pre-processed or post-processed by the image processing module 1035. According to an embodiment, the generating of the voltage value or current value may be performed, for example, based at least in part on one or more attributes of the pixels (e.g., an array, such as an RGB stripe or a pentile structure, of the pixels, or the size of each subpixel). At least some pixels of the display 1010 may be driven, for example, based at least in part on the voltage value or the current value such that visual information (e.g., a text, an image, or an icon) corresponding to the image data may be displayed via the display 1010.

According to an embodiment, the display device 960 may further include the touch circuitry 1050. The touch circuitry 1050 may include a touch sensor 1051 and a touch sensor IC 1053 to control the touch sensor 1051. The touch sensor IC 1053 may control the touch sensor 1051 to sense a touch input or a hovering input with respect to a certain position on the display 1010. To achieve this, for example, the touch sensor 1051 may detect (e.g., measure) a change in a signal (e.g., a voltage, a quantity of light, a resistance, or a quantity of one or more electric charges) corresponding to the certain position on the display 1010. The touch circuitry 1050 may provide input information (e.g., a position, an area, a pressure, or a time) indicative of the touch input or the hovering input detected via the touch sensor 1051 to the processor 920. According to an embodiment, at least part (e.g., the touch sensor IC 1053) of the touch circuitry 1050 may be formed as part of the display 1010 or the DDI 1030, or as part of another component (e.g., the auxiliary processor 923) disposed outside the display device 960.

According to an embodiment, the display device 960 may further include at least one sensor (e.g., a fingerprint sensor, an iris sensor, a pressure sensor, or an illuminance sensor) of the sensor module 976 or a control circuit for the at least one sensor. In such a case, the at least one sensor or the control circuit for the at least one sensor may be embedded in one portion of a component (e.g., the display 1010, the DDI 1030, or the touch circuitry 950)) of the display device 960. For example, when the sensor module 976 embedded in the display device 960 includes a biometric sensor (e.g., a fingerprint sensor), the biometric sensor may obtain biometric information (e.g., a fingerprint image) corresponding to a touch input received via a portion of the display 1010. As another example, when the sensor module 976 embedded in the display device 960 includes a pressure sensor, the pressure sensor may obtain pressure information corresponding to a touch input received via a partial or whole area of the display 1010. According to an embodiment, the touch sensor 1051 or the sensor module 976 may be disposed between pixels in a pixel layer of the display 1010, or over or under the pixel layer.

Figure 11:
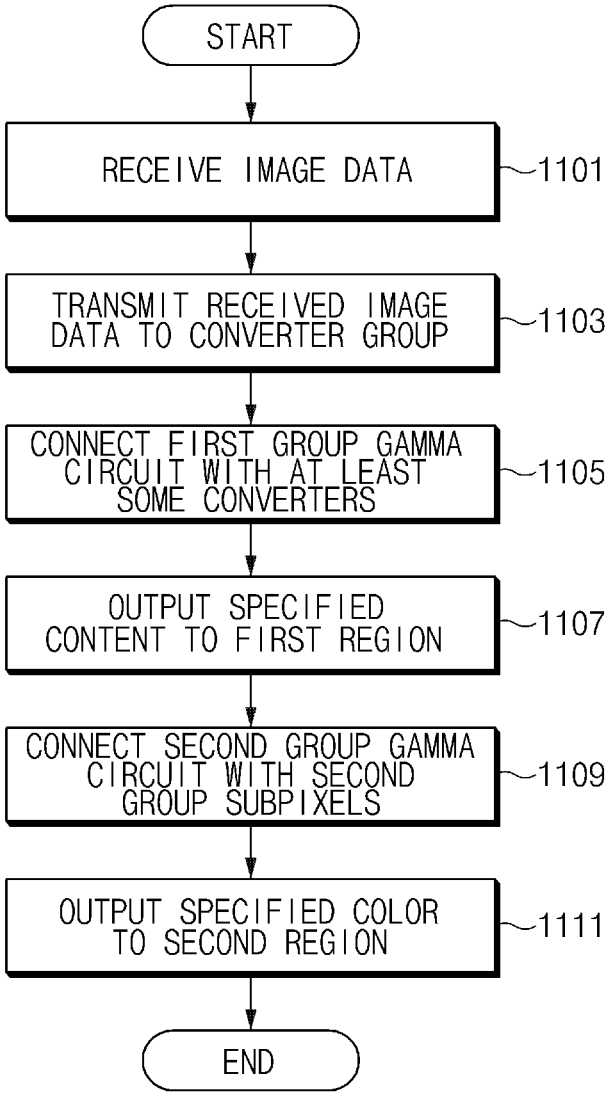
FIG. 11 illustrates a flowchart for displaying content in a specified area in a display according to an embodiment.

FIG. 11 illustrates a flowchart for displaying content in a specified area of a display according to an embodiment.

Referring to FIG. 11, an operation of displaying content on a specified area in a display (e.g., the display 101 of FIG. 2) according to an embodiment may include operations 1101 to 1111. According to an embodiment, operations 1101 to 1111 may be performed by a display driving circuit or a controller.

In operation 1101, the display may receive image data from an external processor. The external processor may be, for example, an application processor. In one embodiment, the image data may be data for outputting specified content on a first region of the display.

In operation 1103, the display may transmit the image data received in operation 1101 to a converter group (the converter group 220 of FIG. 2). The converter group may convert the received image data from a digital signal to an analog signal. The analog signal may be, for example, a source voltage value.

In operation 1105, the display may connect a first group gamma circuit with at least some converters included in the converter group to apply a first grayscale voltage to first group subpixels. The first group gamma circuit may apply the first grayscale voltage to the at least some converters, and the first grayscale voltage may be applied to the first group subpixels connected to the at least some converters.

In operation 1107, the display may output specified content to the first region. The specified content may be output to the first region by applying a source voltage including the first grayscale voltage to the first group subpixels included in the first region.

In operation 1109, the display may connect a second group gamma circuit with second group subpixels to apply a second grayscale voltage to the second group subpixels.

In operation 1111, the display may output a specified color to a second region. The specified color may be output to the second region by applying the second grayscale voltage to the second group subpixels included in the second region.

According to an embodiment, unlike what is shown in FIG. 11, the sequence between operations 1105 to 1107 and operations 1109 to 1111 may be changed. For example, output to the second region may be performed first and then output to the first region may be performed. In this case, operations 1109 and 1111 may be performed after operation 1103 and operations 1105 and 1107 may be then performed.

Figure 12:
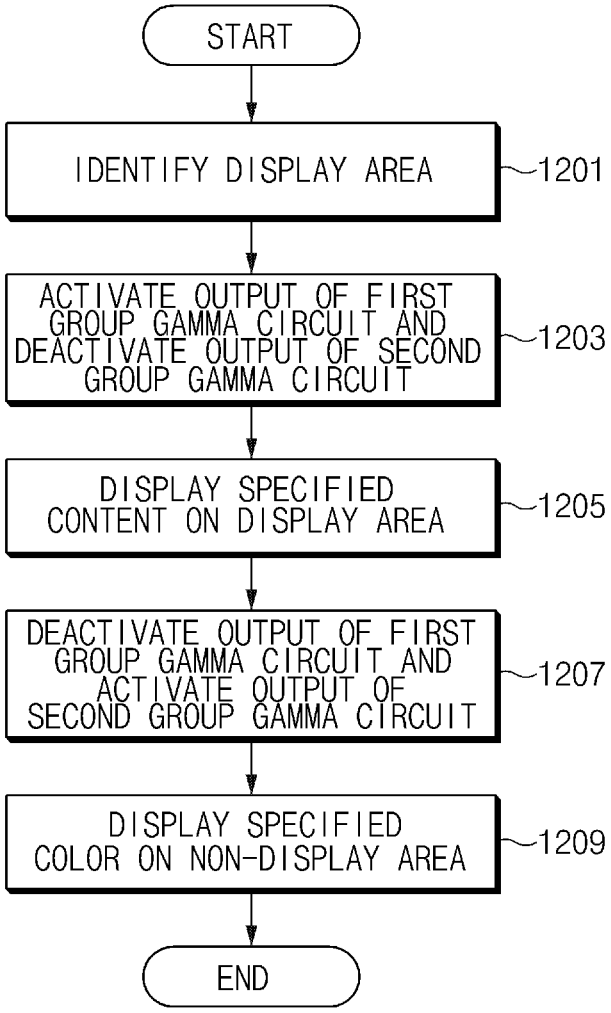
FIG. 12 illustrates a flowchart for displaying content in a specified area in an electronic device, according to an embodiment.

FIG. 12 illustrates a flowchart for displaying content in a specified area in an electronic device, according to an embodiment.

Referring to FIG. 12, an operation of displaying content on a specified area in an electronic device (e.g., the electronic device 100 of FIG. 1) according to an embodiment may include operations 1201 to 1209. According to an embodiment, operations 1201 to 1209 may be performed by a display driving circuit or a controller.

In operation 1201, the electronic device may identify a display area of a display. The display area may be an area on which specified content is to be output. The non-display area may be an area on which the specified content is not to be output corresponding to the display area. In operation 1201, image data may be transmitted to a display driving circuit.

In operation 1203, the electronic device may activate the output of the first group gamma circuit and deactivate the output of the second group gamma circuit. Operation 1203 may be a case in which the electronic device applies a source voltage to the first group subpixels included in the display area. In this case, the first grayscale voltage may be applied to the first group subpixels by the first group gamma circuit.

In operation 1205, the electronic device may display the specified content on the display area. The specified content may be displayed by the first group subpixels to which the first grayscale voltage is applied.

In operation 1207, the electronic device may deactivate the output of the first group gamma circuit and activate the output of the second group gamma circuit. Operation 1207 may be a case in which the electronic device applies the source voltage to the second group subpixels included in the non-display area. In this case, the second grayscale voltage may be applied to the second group subpixels by the second group gamma circuit.

In operation 1209, the electronic device may display a specified color rather than the specified content on the non-display area. The specified color may be, for example, black. The specified color may be displayed by the second group subpixels to which the second grayscale voltage is applied.

According to an embodiment, unlike what is shown in FIG. 12, the sequence between operations 1203 to 1205 and operations 1207 to 1207 may be changed. For example, output to the second region may be performed first and then output to the first region may be performed. In this case, operations 1207 and 1209 may be performed after operation 1201 and operations 1203 and 1205 may be then performed.

According to the embodiments disclosed in the disclosure, it is possible to provide a variety of high-definition content to the user even in the AOD state, thereby increasing user convenience. In addition, it is possible to efficiently control the power consumption in the electronic device, thereby providing a longer usage time to the user.

According to an embodiment, a display may include a display panel including a first region in which first group subpixels are disposed and a second region in which second group subpixels are disposed, a converter group including converters respectively connected to subpixels included in the first group subpixels and the second group subpixels to transfer image data for output of specified content to the subpixels, a first group gamma circuit selectively connected to the converters to output a first grayscale voltage whose intensity is determined based on a plurality of binary bits, a second group gamma circuit selectively connected to the subpixels to output a second grayscale voltage whose intensity is determined based on a single binary bit, and a controller that controls selective connections between the first group gamma circuit and the converters and selective connections between the second group gamma circuit and the subpixels. According to an embodiment, the controller may receive the image data from an external processor and transfer the image data to the converter group, connect the first group gamma circuit with at least some converters such that the first group gamma circuit applies the first grayscale voltage to the at least some converters of the converter group, connect the second group gamma circuit with the second group subpixels such that the second group gamma circuit applies the second grayscale voltage to the second group subpixels, and output the specified content to at least a portion of the first region.

According to an embodiment, the subpixels may include a first subpixel, and the controller may perform control such that a connection between a converter connected to the first subpixel and the first group gamma circuit and a connection between the first subpixel and the second group gamma circuit are selectively made.

According to an embodiment, the display panel may further include a gate driver configured to apply a gate voltage to the subpixels, subpixels to which the gate voltage is applied at a same time point among the subpixels form at least one gate line, and the first region and the second region may be distinguished by a virtual line parallel to the at least one gate line.

According to an embodiment, the controller may control the gate driver to apply the gate voltage to the at least one gate line at a specified time interval for each gate line, the gate driver may sequentially apply the gate voltage in a direction from gate lines included in the second region to gate lines included in the first region, and the specified content may not output to subpixels included in at least one gate line adjacent to the second region among the gate lines included in the first region.

According to an embodiment, the controller may connect the first group gamma circuit with at least some converters such that the first group gamma circuit applies the first grayscale voltage to the at least some converters of the converter group during a specified time, connect the second group gamma circuit with some subpixels connected to the at least some converters among the first group subpixels such that the second group gamma circuit applies the second grayscale voltage to the some subpixels connected to the at least some converters among the first group subpixels after the specified time has elapsed, and connect the second group gamma circuit with the second group subpixels such that the second group gamma circuit applies the second grayscale voltage to the second group subpixels.

According to an embodiment, the controller may receive image data at least partially different from the image data from the external processor and transfer the image data to the converter group, and connect the first group gamma circuit with the at least some converters such that the first group gamma circuit applies the first grayscale voltage to the at least some converters.

According to an embodiment, the controller may connect the first group gamma circuit with at least some converters such that the first group gamma circuit applies the first grayscale voltage to the at least some converters of the converter group during a first time, and connect the second group gamma circuit with the second group subpixels such that the second group gamma circuit applies the second grayscale voltage to the second group subpixels during a second time different from the first time.

According to an embodiment, the first group gamma circuit may include a first switch connected to a terminal to which the first grayscale voltage is output, and the controller may open the first switch during the second time.

According to an embodiment, the second group gamma circuit may include a second switch connected to a terminal to which the second grayscale voltage is output, and the controller may open the second switch during the first time.

According to an embodiment, the first group subpixels may include a first red subpixel, a first green subpixel, and a first blue subpixel, and the subpixels connected to the at least some converters may be at least one of the first red subpixel, the first green subpixel, and the first blue subpixel.

According to an embodiment, the controller may connect the second group gamma circuit with some subpixels of the first group subpixels such that the second group gamma circuit applies the second grayscale voltage to the some subpixels connected to remaining converters except the at least some converters among the first group subpixels.

According to an embodiment, the first group subpixels may include a first red subpixel, a first green subpixel, and a first blue subpixel, and the some subpixels of the first group subpixels may be at least one of the first red subpixel, the first green subpixel, and the first blue subpixel.

According to an embodiment, the display may further include a source amplifier group that amplifies image data transferred from the converter group to the subpixels.

According to an embodiment, the converter group may convert the image data from a digital signal to an analog signal.

According to an embodiment, the display may further include a gamma adjustment circuit that provides a gamma reference voltage to the first gamma circuit and the second gamma circuit and the controller may control the gamma adjustment circuit such that the gamma reference voltage has a specified magnitude.

According to an embodiment, an electronic device may include a display panel including a display area and a non-display area, and a display driving circuit that drives the display panel and includes a gamma driving circuit including a first group gamma circuit and a second group gamma circuit, and the display driving circuit may identify the display area on which content is to be displayed, display the content on the display area using the gamma driving circuit set to a state in which an output of the first group gamma circuit is activated and an output of the second group gamma circuit is deactivated, and display a specified color on the non-display area on which the content is not displayed, using the gamma driving circuit set to a state in which the output of the first group gamma circuit is deactivated and the output of the second group gamma circuit is activated.

According to an embodiment, the display driving circuit may display the content on the display area using the gamma driving circuit in the state in which the output of the first group gamma circuit is activated and the output of the second group gamma circuit is deactivated during a specified time, and display the content on the display area using the gamma driving circuit in the state in which the output of the first group gamma circuit is deactivated and the output of the second group gamma circuit is activated after the specified time elapses.

According to an embodiment, the content may correspond to first content, the display driving circuit may receive data for output of second content different from the first content and display the second content on the display area using the gamma driving circuit in response to reception of the data in the state in which the output of the first group gamma circuit is activated and the output of the second group gamma circuit is deactivated.

According to an embodiment, the first group gamma circuit may include a gamma amplifier.

According to an embodiment, the second group gamma circuit may include an inverter.

The electronic device according to various embodiments disclosed in the present disclosure may be various types of devices. The electronic device may include, for example, at least one of a portable communication device (e.g., a smartphone), a computer device, a portable multimedia device, a mobile medical appliance, a camera, a wearable device, or a home appliance. The electronic device according to an embodiment of the present disclosure should not be limited to the above-mentioned devices.

It should be understood that various embodiments of the present disclosure and terms used in the embodiments do not intend to limit technologies disclosed in the present disclosure to the particular forms disclosed herein; rather, the present disclosure should be construed to cover various modifications, equivalents, and/or alternatives of embodiments of the present disclosure. With regard to description of drawings, similar components may be assigned with similar reference numerals. As used herein, singular forms may include plural forms as well unless the context clearly indicates otherwise. In the present disclosure disclosed herein, the expressions "A or B", "at least one of A or/and B", "A, B, or C" or "one or more of A, B, or/and C", and the like used herein may include any and all combinations of one or more of the associated listed items. The expressions "a first", "a second", "the first", or "the second", used in herein, may refer to various components regardless of the order and/or the importance, but do not limit the corresponding components. The above expressions are used merely for the purpose of distinguishing a component from the other components. It should be understood that when a component (e.g., a first component) is referred to as being (operatively or communicatively) "connected," or "coupled," to another component (e.g., a second component), it may be directly connected or coupled directly to the other component or any other component (e.g., a third component) may be interposed between them.

The term "module" used herein may represent, for example, a unit including one or more combinations of hardware, software and firmware. The term "module" may be interchangeably used with the terms "logic", "logical block", "part" and "circuit". The "module" may be a minimum unit of an integrated part or may be a part thereof. The "module" may be a minimum unit for performing one or more functions or a part thereof. For example, the "module" may include an application-specific integrated circuit (ASIC).

Various embodiments of the present disclosure may be implemented by software (e.g., the program 940) including an instruction stored in a machine-readable storage media (e.g., an internal memory 936 or an external memory 938) readable by a machine (e.g., a computer). The machine may be a device that calls the instruction from the machine-readable storage media and operates depending on the called instruction and may include the electronic device (e.g., the electronic device 901). When the instruction is executed by the processor (e.g., the processor 920), the processor may perform a function corresponding to the instruction directly or using other components under the control of the processor. The instruction may include a code generated or executed by a compiler or an interpreter. The machine-readable storage media may be provided in the form of non-transitory storage media. Here, the term "non-transitory", as used herein, is a limitation of the medium itself (i.e., tangible, not a signal) as opposed to a limitation on data storage persistency.

According to an embodiment, the method according to various embodiments disclosed in the present disclosure may be provided as a part of a computer program product. The computer program product may be traded between a seller and a buyer as a product. The computer program product may be distributed in the form of machine-readable storage medium (e.g., a compact disc read only memory (CD-ROM)) or may be distributed only through an application store (e.g., a Play Store™). In the case of online distribution, at least a portion of the computer program product may be temporarily stored or generated in a storage medium such as a memory of a manufacturer's server, an application store's server, or a relay server.

Each component (e.g., the module or the program) according to various embodiments may include at least one of the above components, and a portion of the above sub-components may be omitted, or additional other sub-components may be further included. Alternatively or additionally, some components (e.g., the module or the program) may be integrated in one component and may perform the same or similar functions performed by each corresponding components prior to the integration. Operations performed by a module, a programming, or other components according to various embodiments of the present disclosure may be executed sequentially, in parallel, repeatedly, or in a heuristic method. Also, at least some operations may be executed in different sequences, omitted, or other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

The invention claimed is:

1. A display device, comprising:

a display panel including a first region in which first group subpixels are disposed and a second region in which second group subpixels are disposed;

a converter group including converters respectively connected to subpixels included in the first group subpixels and the second group subpixels to transfer image data for output of specified content to the subpixels;

a first group gamma circuit selectively connected to the converters to output a first grayscale voltage whose intensity is determined based on a plurality of binary bits;

a second group gamma circuit selectively connected to the subpixels to output a second grayscale voltage whose intensity is determined based on a single binary bit; and a controller configured to control selective connections between the first group gamma circuit and the converters and selective connections between the second group gamma circuit and the subpixels, wherein the controller is configured to:

receive the image data from an external processor and transfer the image data to the converter group, connect the first group gamma circuit with at least some converters of the converters such that the first group gamma circuit applies the first grayscale voltage to the at least some converters of the converter group, connect the second group gamma circuit with the second group subpixels such that the second group gamma circuit applies the second grayscale voltage to the second group subpixels, and output the specified content to at least a portion of the first region.

2. The display device of claim 1, wherein the subpixels include a first subpixel, and wherein the controller performs control such that a connection between a converter connected to the first subpixel and the first group gamma circuit and a connection between the first subpixel and the second group gamma circuit are selectively made.

3. The display device of claim 1, wherein the display panel further includes a gate driver configured to apply a gate voltage to the subpixels, wherein subpixels to which the gate voltage is applied at a same time point among the subpixels form at least one gate line, and wherein the first region and the second region are distinguished by a virtual line parallel to the at least one gate line.

4. The display device of claim 3, wherein the controller controls the gate driver to apply the gate voltage to the at least one gate line at a specified time interval for each gate line, wherein the gate driver sequentially applies the gate voltage in a direction from gate lines included in the second region to gate lines included in the first region, and wherein the specified content is not output to subpixels included in at least one gate line adjacent to the second region among the gate lines included in the first region.

5. The display device of claim 1, wherein the controller is configured to:

connect the first group gamma circuit with at least some converters such that the first group gamma circuit applies the first grayscale voltage to the at least some converters of the converter group during a specified time, connect the second group gamma circuit with some subpixels connected to the at least some converters among the first group subpixels such that the second group gamma circuit applies the second grayscale voltage to the some subpixels connected to the at least some converters among the first group subpixels after the specified time has elapsed, and connect the second group gamma circuit with the second group subpixels such that the second group gamma circuit applies the second grayscale voltage to the second group subpixels.

6. The display device of claim 5, wherein the controller is configured to:

receive image data at least partially different from the image data from the external processor and transfer the image data to the converter group, and connect the first group gamma circuit with the at least some converters such that the first group gamma circuit applies the first grayscale voltage to the at least some converters.

7. The display device of claim 1, wherein the controller is configured to:

connect the first group gamma circuit with at least some converters such that the first group gamma circuit applies the first grayscale voltage to the at least some converters of the converter group during a first time, and connect the second group gamma circuit with the second group subpixels such that the second group gamma circuit applies the second grayscale voltage to the second group subpixels during a second time different from the first time.

8. The display device of claim 7, wherein the first group gamma circuit includes a first switch connected to a terminal to which the first grayscale voltage is output, and wherein the controller opens the first switch during the second time.

9. The display device of claim 7, wherein the second group gamma circuit includes a second switch connected to a terminal to which the second grayscale voltage is output, and wherein the controller opens the second switch during the first time.

10. The display device of claim 1, wherein the first group subpixels include a first red subpixel, a first green subpixel, and a first blue subpixel, and wherein the subpixels connected to the at least some converters is at least one of the first red subpixel, the first green subpixel, and the first blue subpixel.

* * * * *